US009761187B2

(12) United States Patent
Inada et al.

(10) Patent No.: US 9,761,187 B2
(45) Date of Patent: Sep. 12, 2017

(54) LIQUID CRYSTAL DISPLAY DEVICE AND METHOD FOR DRIVING SAME

(71) Applicant: Sharp Kabushiki Kaisha, Osaka-shi, Osaka (JP)

(72) Inventors: Ken Inada, Osaka (JP); Taketoshi Nakano, Osaka (JP); Akizumi Fujioka, Osaka (JP); Asahi Yamato, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 78 days.

(21) Appl. No.: 14/432,766

(22) PCT Filed: Jul. 26, 2013

(86) PCT No.: PCT/JP2013/070385
§ 371 (c)(1),
(2) Date: Apr. 1, 2015

(87) PCT Pub. No.: WO2014/054331
PCT Pub. Date: Apr. 10, 2014

(65) Prior Publication Data

US 2015/0279294 A1 Oct. 1, 2015

(30) Foreign Application Priority Data

Oct. 2, 2012 (JP) ..... 2012-220356

(51) Int. Cl.
*G09G 3/36* (2006.01)

(52) U.S. Cl.
CPC ..... *G09G 3/3614* (2013.01); *G09G 3/3688* (2013.01); *G09G 2320/0247* (2013.01);
(Continued)

(58) Field of Classification Search
None
See application file for complete search history.

(56) References Cited

U.S. PATENT DOCUMENTS 6,483,492 B1 11/2002 Takeuchi et al.
RE40,489 E 9/2008 Takeuchi et al.
(Continued)

FOREIGN PATENT DOCUMENTS

EP 2 889 868 A1 7/2015
JP 2004-004629 A 1/2004
(Continued)

OTHER PUBLICATIONS

Official Communication issued in International Patent Application No. PCT/JP2013/070385, mailed on Oct. 29, 2013.

*Primary Examiner* — Nicholas Lee
*Assistant Examiner* — Duane N Taylor, Jr.
(74) *Attorney, Agent, or Firm* — Keating & Bennett, LLP

(57) ABSTRACT

Grayscale values for previous and current frames are different, and therefore, an overshoot voltage, which has a higher absolute value than a signal voltage, are applied to a data signal line. Next, in a second drive frame, normal drive is performed, so that a signal voltage of the same polarity as the overshoot voltage is written to the data signal line. Moreover, in a first drive frame of a third pause drive period, the grayscale values for the previous and current frames are equal, and also greater than or equal to a boundary value, and therefore, undershoot drive is performed. An undershoot voltage, which has a lower absolute value than a signal voltage, is applied to the data signal line. Next, in a second drive frame, normal drive is performed, so that a signal voltage of the same polarity as the undershoot voltage is written to the data signal line.

11 Claims, 37 Drawing Sheets

(52) U.S. Cl.
CPC ..... *G09G 2320/0252* (2013.01); *G09G 2320/0285* (2013.01); *G09G 2320/041* (2013.01); *G09G 2320/046* (2013.01); *G09G 2320/064* (2013.01); *G09G 2320/10* (2013.01); *G09G 2320/103* (2013.01); *G09G 2330/021* (2013.01); *G09G 2330/023* (2013.01); *G09G 2330/04* (2013.01); *G09G 2340/0435* (2013.01); *G09G 2340/16* (2013.01); *G09G 2360/16* (2013.01)

(56) References Cited

U.S. PATENT DOCUMENTS

| | | | | |
|---|---|---|---|---|
| 2003/0179175 | A1 | 9/2003 | Shigeta et al. | |
| 2006/0158415 | A1 | 7/2006 | Izumi | |
| 2007/0018927 | A1 | 1/2007 | Kim | |
| 2008/0001889 | A1* | 1/2008 | Chun | G09G 3/2011 345/96 |
| 2008/0069479 | A1* | 3/2008 | Park | G09G 3/3648 382/300 |
| 2008/0224980 | A1 | 9/2008 | Senda et al. | |
| 2010/0182218 | A1* | 7/2010 | Daniel | G09F 9/33 345/1.3 |
| 2011/0074938 | A1 | 3/2011 | Nakahata | |
| 2011/0157128 | A1 | 6/2011 | Koyama | |
| 2011/0255778 | A1 | 10/2011 | Hashimoto et al. | |
| 2013/0002834 | A1 | 1/2013 | Aiba | |
| 2013/0057791 | A1 | 3/2013 | Kitayama et al. | |
| 2015/0235600 | A1 | 8/2015 | Inada et al. | |

FOREIGN PATENT DOCUMENTS

| | | | |
|---|---|---|---|
| JP | 2004-185025 | A | 7/2004 |
| JP | 2006-195231 | A | 7/2006 |
| JP | 2006-267360 | A | 10/2006 |
| JP | 2011-008270 | A | 1/2011 |
| JP | 2011-075668 | A | 4/2011 |
| JP | 2011-75746 | A | 4/2011 |
| JP | 2011-150322 | A | 8/2011 |
| JP | 2011-205186 | A | 10/2011 |
| JP | 2011-221441 | A | 11/2011 |
| KR | 10-2008-0084081 | A | 9/2008 |
| WO | 2011/145584 | A1 | 11/2011 |
| WO | 2014/030411 | A1 | 2/2014 |

* cited by examiner

FIG. 2

70

| | | GRAYSCALE VALUES FOR FOR CURRENT FRAME | | | | | | | | |
|---|---|---|---|---|---|---|---|---|---|---|
| | | 0 | 32 | 64 | 96 | 128 | 160 | 192 | 224 | 255 |
| GRAYSCALE VALUES FOR PREVIOUS FRAME | 0 | 3 | 8 | 7 | 6 | 5 | 3 | 1 | 1 | 1 |
| | 32 | 4 | 5 | 9 | 8 | 7 | 6 | 6 | 4 | 4 |
| | 64 | 5 | 6 | 4 | 9 | 5 | 5 | 4 | 4 | 3 |
| | 96 | 4 | 7 | 4 | 4 | 4 | 4 | 3 | 2 | 2 |
| | 128 | 3 | 3 | 4 | 4 | 4 | 5 | 4 | 4 | 2 |
| | 160 | 3 | 3 | 4 | 4 | 4 | 1 | 4 | 4 | 1 |
| | 192 | 2 | 3 | 3 | 3 | 3 | 4 | 0 | 5 | 1 |
| | 224 | 2 | 2 | 2 | 2 | 3 | 3 | 3 | -2 | 0 |
| | 255 | 1 | 2 | 2 | 3 | 3 | 2 | 1 | 1 | -3 |

FIG. 17

270

| | | GRAYSCALE VALUES FOR CURRENT FRAME | | | | | | | | |
|---|---|---|---|---|---|---|---|---|---|---|
| | | 0 | 32 | 64 | 96 | 128 | 160 | 192 | 224 | 255 |
| GRAYSCALE VALUES FOR PREVIOUS FRAME | 0 | 3 | — | — | — | — | — | — | — | — |
| | 32 | — | 5 | — | — | — | — | — | — | — |
| | 64 | — | — | 4 | — | — | — | — | — | — |
| | 96 | — | — | — | 4 | — | — | — | — | — |
| | 128 | — | — | — | — | 4 | — | — | — | — |
| | 160 | — | — | — | — | — | 1 | — | — | — |
| | 192 | — | — | — | — | — | — | 0 | — | — |
| | 224 | — | — | — | — | — | — | — | −2 | — |
| | 255 | — | — | — | — | — | — | — | — | −3 |

370

| GRAYSCALE VALUES FOR CURRENT FRAME | | | | | | | | |
|---|---|---|---|---|---|---|---|---|
| 0 | 32 | 64 | 96 | 128 | 160 | 192 | 224 | 255 |
| 3 | 8 | 7 | 6 | 5 | 3 | 0 | −1 | −2 |

FIG. 21

FIG. 28

470a

| | | GRAYSCALE VALUES FOR CURRENT FRAME | | | | | | | | |
|---|---|---|---|---|---|---|---|---|---|---|
| | | 0 | 32 | 64 | 96 | 128 | 160 | 192 | 224 | 255 |
| GRAYSCALE VALUES FOR PREVIOUS FRAME | 0 | 3 | 8 | 7 | 6 | 5 | 3 | 1 | 1 | 1 |
| | 32 | 4 | 5 | 9 | 8 | 7 | 6 | 6 | 4 | 4 |
| | 64 | 5 | 6 | 4 | 9 | 5 | 5 | 4 | 4 | 3 |
| | 96 | 4 | 7 | 4 | 4 | 4 | 4 | 3 | 2 | 2 |
| | 128 | 3 | 3 | 4 | 4 | 4 | 5 | 4 | 4 | 2 |
| | 160 | 3 | 3 | 4 | 4 | 4 | 3 | 4 | 4 | 1 |
| | 192 | 2 | 3 | 3 | 3 | 3 | 4 | 0 | 5 | 1 |
| | 224 | 2 | 2 | 2 | 2 | 3 | 3 | 3 | −2 | 0 |
| | 255 | 1 | 2 | 2 | 3 | 3 | 2 | 1 | 1 | −4 |

FIG. 29

470b

| | | GRAYSCALE VALUES FOR CURRENT FRAME | | | | | | | | |
|---|---|---|---|---|---|---|---|---|---|---|
| | | 0 | 32 | 64 | 96 | 128 | 160 | 192 | 224 | 255 |
| GRAYSCALE VALUES FOR PREVIOUS FRAME | 0 | 2 | 4 | 4 | 3 | 3 | 2 | 1 | 1 | 1 |
| | 32 | 2 | 3 | 5 | 4 | 4 | 3 | 3 | 2 | 2 |
| | 64 | 3 | 3 | 2 | 5 | 3 | 3 | 2 | 2 | 2 |
| | 96 | 2 | 4 | 2 | 2 | 2 | 2 | 2 | 1 | 1 |
| | 128 | 2 | 2 | 2 | 2 | 2 | 3 | 2 | 2 | 1 |
| | 160 | 2 | 2 | 2 | 2 | 2 | 2 | 2 | 2 | 1 |
| | 192 | 1 | 2 | 2 | 2 | 2 | 2 | 0 | 3 | 1 |
| | 224 | 1 | 1 | 1 | 1 | 2 | 2 | 2 | −1 | 0 |
| | 255 | 1 | 1 | 1 | 2 | 2 | 1 | 1 | 1 | −3 |

FIG. 30

470c

| | | GRAYSCALE VALUES FOR CURRENT FRAME | | | | | | | | |
|---|---|---|---|---|---|---|---|---|---|---|
| | | 0 | 32 | 64 | 96 | 128 | 160 | 192 | 224 | 255 |
| GRAYSCALE VALUES FOR PREVIOUS FRAME | 0 | 6 | 12 | 12 | 9 | 9 | 6 | 3 | 3 | 3 |
| | 32 | 6 | 9 | 15 | 12 | 12 | 9 | 9 | 6 | 6 |
| | 64 | 9 | 9 | 6 | 15 | 9 | 9 | 6 | 6 | 6 |
| | 96 | 6 | 12 | 6 | 6 | 6 | 6 | 6 | 3 | 3 |
| | 128 | 6 | 6 | 6 | 6 | 6 | 9 | 6 | 6 | 3 |
| | 160 | 6 | 6 | 6 | 6 | 6 | 6 | 6 | 6 | 3 |
| | 192 | 3 | 6 | 6 | 6 | 6 | 6 | 0 | 9 | 3 |
| | 224 | 3 | 3 | 3 | 3 | 6 | 6 | 6 | −3 | 0 |
| | 255 | 3 | 3 | 3 | 6 | 6 | 3 | 3 | 3 | −5 |

FOR GRAYSCALE 64 AND 128

FOR GRAYSCALE 240

LIQUID CRYSTAL DISPLAY DEVICE AND METHOD FOR DRIVING SAME

TECHNICAL FIELD

The present invention relates to liquid crystal display devices and methods for driving the same, particularly to a liquid crystal display device capable of performing pause drive in an alternating-voltage drive mode and a method for driving the same.

BACKGROUND ART

Recent years have seen active development of compact and lightweight electronic devices. Liquid crystal display devices mounted in such electronic devices are required to consume less power. A drive method to reduce power consumption by the liquid crystal display device is a drive method called "pause drive" with drive periods in which scanning lines are scanned to write signal voltages and pause periods in which the writing is paused by keeping all of the scanning lines in unscanned state. In the pause drive, a scanning line driver circuit and/or a data signal line driver circuit are/is provided with no control signals and suchlike during the pause period, so that the operation of the scanning line driver circuit and/or the data signal line driver circuit can be stopped, thereby reducing power consumption by the liquid crystal display device. The pause drive as described above is also referred to as "low-frequency drive" or "intermittent drive".

When a voltage is applied to a liquid crystal layer sandwiched between a pixel electrode and a common electrode in a liquid crystal panel for use in the liquid crystal display device, the orientation direction (i.e., the longitudinal direction) of liquid crystal molecules changes because of dielectric anisotropy of the liquid crystal. Moreover, liquid crystals have optical anisotropy, and therefore, when the orientation direction of the liquid crystal molecules changes, the direction of polarization of light to be transmitted through the liquid crystal layer changes. Accordingly, with the voltage applied to the liquid crystal layer, it is possible to control the amount of light to be transmitted through the liquid crystal layer and display an image on the liquid crystal panel.

However, it takes a certain period of time for the liquid crystal to respond to a change in the applied voltage. For example, in the case of a widely used TN (Twisted Nematic), IPS (In-Plane Switching), or VA (Vertically Aligned) liquid crystal display device, it might take a time period of about 50 ms until the liquid crystal responds. In addition, the response speed of the liquid crystal changes in accordance with the temperature, and the response speed decreases as the temperature lowers.

Furthermore, when the frequency of an image signal is 60 Hz, one frame period is 16.7 ms. Accordingly, if the response period of the liquid crystal becomes longer than one frame period, image lag might occur on the screen, resulting in reduced image display quality.

Therefore, to solve the above problems, for example, Japanese Laid-Open Patent Publication No. 2004-4629 discloses a liquid crystal display device in which "overshoot drive" is performed to apply a higher voltage to a liquid crystal layer than a normally applied voltage. In the overshoot drive, a look-up table (referred to as an "LUT" or a "table") is used in which correction values are stored and correlated with their respective combinations of grayscale values for the previous and current frames. More specifically, a correction value correlated with a combination of grayscale values for the previous and current frames is read from the LUT and used to correct an input image signal, so that the corrected image signal is outputted. By performing overshoot drive using such a corrected image signal, it is rendered possible to increase the display speed of the liquid crystal display device.

PRIOR ART DOCUMENT

Patent Document

Patent Document 1: Japanese Laid-Open Patent Publication No. 2004-4629

SUMMARY OF THE INVENTION

Problems to be Solved by the Invention

In the liquid crystal display device, if voltages of the same polarity continue to be applied to the liquid crystal layer, burn-in might occur on the liquid crystal layer, resulting in deterioration of the liquid crystal layer. Therefore, to prevent burn-in on the liquid crystal layer, alternating-voltage drive in which the polarity of signal voltages is inverted upon each writing is performed. FIG. 34 is a diagram describing a conventional method for performing pause drive in an alternating-voltage drive mode. As shown in FIG. 34, in a first pause drive period, initially, signal voltages of the positive polarity are written, and the signal voltages are maintained during the following pause period. In a second pause drive period, initially, signal voltages of the negative polarity are written, and the signal voltages are maintained during the following pause period. Thereafter, similar operations are repeated such that signal voltages are written with their polarities inverted alternatingly every pause drive period, and maintained during their respective following pause periods.

FIG. 35 is a diagram schematically illustrating luminance changes where input image signals that correspond to the grayscale values "64", "128", "200", and "240" are written in pixel forming portions by conventional pause drive in an alternating-voltage drive mode. In the case of a liquid crystal display device capable of providing display with 256 grayscale values from 0 (display in black) to 255 (display in white), when the input image signal corresponds to the grayscale value "64", the luminance sharply drops immediately after signal voltages are written in the pixel forming portions, and slowly returns to its original level, as shown in FIG. 35. In the case of the grayscale value "128", similarly, the luminance drops immediately after signal voltages are written in the pixel forming portions, and slowly returns to its original level. However, the luminance drop immediately after the writing of the signal voltages in the pixel forming portions is less than in the case of the grayscale value "64". Moreover, in the case of the grayscale value "200", the luminance does not change when signal voltages are written in the pixel forming portions. On the other hand, in the case of the grayscale value "240", the luminance rises immediately after signal voltages are written in the pixel forming portions, and slowly drops thereafter.

FIG. 36 is a diagram describing luminance changes where an input image signal with the grayscale value "64" is written by conventional pause drive in an alternating-voltage drive mode, and FIG. 37 is a diagram describing luminance changes where an input image signal with the grayscale value "240" is written by conventional pause drive in an alternating-voltage drive mode. First, the reason why the luminance sharply drops immediately after an input image signal with the grayscale value "64" is written, and thereafter slowly returns to its original level will be described with reference to FIG. 36. In FIG. 36, pixel forming portion A and pixel forming portion B are pixel forming portions that are adjacent to each other and differ in polarity because of inversion drive. In a certain drive period, pixel forming portion A has the positive polarity, whereas pixel forming portion B has the negative polarity. Their polarities are inverted in the next drive period, so that pixel forming portion A has the negative polarity, whereas pixel forming portion B has the positive polarity. By inverting the polarity of a signal voltage applied to pixel forming portion A from positive to negative, the luminance of pixel forming portion A drops sharply to a constant value. On the other hand, by inverting the polarity of a signal voltage applied to pixel forming portion B from negative to positive, the luminance of pixel forming portion B rises slowly and approaches a constant value. In this case, the viewer recognizes the combined luminance change of pixel forming portions A and B as the luminance of the entire screen, and therefore, visually recognizes the luminance of the entire screen as sharply dropping upon polarity inversion and thereafter slowly returning to its original level.

While the foregoing has been given with respect to the case of the input image signal with the grayscale value "64", the same applies to the case of the input image signal with the grayscale value "128". However, in the case of the grayscale value "128", the luminance drop upon polarity inversion is less than in the case of the grayscale value "64".

Next, the case where an input image signal with the grayscale value "240" is written will be described. The reason why the luminance sharply rises immediately after an input image signal with the grayscale value "240" is written, and drops slowly thereafter will be described with reference to FIG. 37. As in the case shown in FIG. 36, pixel forming portion A and pixel forming portion B are pixel forming portions that are adjacent to each other and differ in polarity because of inversion drive. In a certain drive period, pixel forming portion A has the positive polarity, whereas pixel forming portion B has the negative polarity. Their polarities are inverted in the next drive period, so that pixel forming portion A has the negative polarity, whereas pixel forming portion B has the positive polarity. If a signal voltage of the negative polarity is applied to pixel forming portion A at the time of polarity inversion, the luminance of pixel forming portion A slowly drops and approaches a constant value. On the other hand, if a signal voltage of the negative polarity is applied to pixel forming portion B, the luminance of pixel forming portion B sharply rises to a constant value. In this case, the viewer recognizes the combined luminance change of pixel forming portions A and B as the luminance of the entire screen, and therefore, visually recognizes the luminance of the entire screen as sharply rising upon polarity inversion and slowly dropping thereafter.

Such a screen luminance change is a phenomenon which occurs when the polarity of the signal voltages is inverted, because the orientation direction of liquid crystal molecules cannot follow such a polarity change. When a video is displayed, such a luminance change can barely be recognized by the viewer because the image changes fast. However, during pause drive, the viewer recognizes such a luminance change as flicker, so there is a problem with reduced image display quality. Flicker occurs even when the grayscale value of the input image signal is constant.

Note that the reason why the luminance during the pause period rises gradually as the voltages which have fallen at the time of polarity inversion approach the signal voltages over time is because thin-film transistors (referred to below as "TFTs") whose channel layers are made of an oxide semiconductor are used as switching elements in the pixel forming portions. Details of the TFTs whose channel layers are made of an oxide semiconductor will be described later.

Japanese Laid-Open Patent Publication No. 2004-4629 discloses overshoot drive for normal drive. However, Japanese Laid-Open Patent Publication No. 2004-4629 neither discloses nor suggests overshoot drive capable of preventing flicker from occurring at the time of pause drive in an alternating-voltage drive mode.

Therefore, an objective of the present invention is to provide a liquid crystal display device capable of suppressing a decrease in display quality when pause drive is performed in an alternating-voltage drive mode, as well as a method for driving the same.

Means for Solving the Problems

According to a first aspect of the present invention, there is provided a liquid crystal display device formed on an insulating substrate and performing pause drive in an alternating-voltage drive mode, the device including:

a plurality of scanning signal lines;

a plurality of data signal lines crossing each of the scanning signal lines;

pixel forming portions formed at intersections of the scanning signal lines and the data signal lines;

a correction circuit for outputting either a corrected image signal obtained by subjecting an input image signal to a tone emphasizing process for emphasizing a temporal change in the signal or an image signal being the input image signal not subjected to the tone emphasizing process;

a scanning signal line driver circuit for sequentially selecting and scanning the scanning signal lines;

a data signal line driver circuit for writing signal voltages to the data signal lines in accordance with the image signal, as well as at least one of first and second correction voltages in accordance with the corrected image signal, the first correction voltage having a higher absolute value than the signal voltage, the second correction voltage having a lower absolute value than the signal voltage; and a timing control circuit for controlling the scanning signal line driver circuit and the data signal line driver circuit, wherein, the pause drive alternatingly repeats a drive period consisting of a plurality of drive frames and a pause period following the drive period and lasting until the start of the next drive period, the correction circuit outputs the corrected image signal to the data signal line driver circuit at least during the first drive frame of the drive period and also outputs the image signal to the data signal line driver circuit during the last drive frame, and the data signal line driver circuit writes the first or second correction voltage at least once to the data signal line, and further, writes a signal voltage having the same polarity as the written first or second correction voltage, once to the data signal line.

According to a second aspect of the present invention, in the first aspect of the present invention, wherein, the correction circuit includes:

frame memory for storing the input image signal every frame;

a table having stored correction values correlated with grayscale values at least for a current frame for the input image signal; and an adder circuit for outputting either the corrected image signal or the image signal to the data signal line driver circuit in accordance with the input image signal, the table provides the adder circuit with a correction value correlated with the grayscale value for the current frame for the input image signal every time the adder circuit is provided with the grayscale value for the current frame, and the adder circuit outputs the corrected image signal by correcting the grayscale value for the input image signal with the correction value provided by the table and also outputs the image signal without correcting the grayscale value for the input image signal.

According to a third aspect of the present invention, in the second aspect of the present invention, wherein, the correction circuit further includes a comparator circuit for obtaining a grayscale value for a current frame for the input image signal and a grayscale value for a previous frame stored in the frame memory and outputting the obtained values to the table, and the table has stored therein correction values correlated with combinations of grayscale values for the current and previous frames for the input image signal, and outputs a correction value for a corresponding one of the combinations to the adder circuit when grayscale values for the current and previous frames for the input image signal are provided by the comparator circuit.

According to a fourth aspect of the present invention, in the third aspect of the present invention, wherein the adder circuit outputs the corrected image signal in each of two or more consecutive drive frames including the first drive frame, and outputs the image signal during the last drive frame.

According to a fifth aspect of the present invention, in the third aspect of the present invention, wherein, the comparator circuit further obtains an inverting direction in which the input image signal is inverted in polarity for each of the drive periods, and the table includes first and second tables having different correction values stored for corresponding polarity directions, such that every time grayscale values for the current and previous frames for the input image signal and a polarity direction are provided by the comparator circuit, the adder circuit is provided with a correction value correlated with the grayscale values for the current and previous frames from one of the first and second tables that corresponds to the polarity direction.

According to a sixth aspect of the present invention, in the first aspect of the present invention, wherein, the correction circuit includes:

frame memory for storing the input image signal every frame;

a comparator circuit for obtaining a grayscale value for a current frame for the input image signal and a grayscale value for a previous frame stored in the frame memory;

a table having correction values stored for essentially equal grayscale values for the current and previous frames for the input image signal; and an adder circuit for outputting either the corrected image signal or the image signal to the data signal line driver circuit in accordance with the input image signal, the comparator circuit provides the table with grayscale values for the current and previous frames for the input image signal when the grayscale values for the current and previous frames for the input image signal are essentially equal, the table outputs to the adder circuit a correction value correlated with the grayscale values for the current and previous frames provided by the comparator circuit, when the grayscale values for the current and previous frames for the input image signal are essentially equal, the adder circuit outputs the corrected image signal by correcting the grayscale value for the input image signal with the correction value provided by the table and also outputs the image signal without correcting the grayscale value for the input image signal, and when the grayscale values for the current and previous frames for the input image signal are essentially not equal, the adder circuit outputs the corrected image signal at least once without correcting the grayscale value for the input image signal.

According to a seventh aspect of the present invention, in the sixth aspect of the present invention, wherein, when the grayscale values for the current and previous frames for the input image signal are essentially not equal, the adder circuit further outputs the corrected image signal without correcting the grayscale value for the input image signal.

According to an eighth aspect of the present invention, in the second or sixth aspect of the present invention, further comprising a temperature sensor for measuring an ambient temperature around the liquid crystal display device, wherein, the table includes a plurality of sub-tables having stored different correction values for predetermined temperature ranges, such that one of the sub-tables is selected in accordance with temperature information provided by the temperature sensor.

According to a ninth aspect of the present invention, in the second or sixth aspect of the present invention, further comprising a temperature sensor for measuring an ambient temperature around the liquid crystal display device, wherein, the correction circuit further includes nonvolatile memory for storing a plurality of data items for different correction values for predetermined temperature ranges, and the nonvolatile memory selects one of the data items in accordance with temperature information provided by the temperature sensor and provides the selected data item to the table.

According to an eleventh aspect of the present invention, in the eighth or ninth aspect of the present invention, wherein the temperature sensor is provided in the timing control circuit.

According to a twelfth aspect of the present invention, in the first aspect of the present invention, wherein the pixel forming portion includes a thin-film transistor having a control terminal connected to the scanning signal line, a first conductive terminal connected to the data signal line, a second conductive terminal connected to a pixel electrode to which the first correction voltage, the second correction voltage, or the signal voltage is to be applied, and a channel layer formed of an oxide semiconductor.

According to a thirteenth aspect of the present invention, in the twelfth aspect of the present invention, wherein the oxide semiconductor is InGaZnO mainly composed of indium (In), gallium (Ga), zinc (Zn), and oxygen (O).

According to a fourteenth aspect of the present invention, in the first aspect of the present invention, wherein the pixel forming portion includes a thin-film transistor having a control terminal connected to the scanning signal line, a first conductive terminal connected to the data signal line, a second conductive terminal connected to a pixel electrode to which the first correction voltage, the second correction voltage, or the signal voltage is to be applied, and a channel layer formed of either an amorphous semiconductor or a polycrystalline semiconductor.

According to a fifteenth aspect of the present invention, in any of the first through fourteenth aspect of the present invention, wherein the liquid crystal display device is driven by dot-by-dot inversion drive, line-by-line inversion drive, column-by-column inversion drive, or frame-by-frame inversion drive in the alternating-voltage drive mode.

According to a sixteenth aspect of the present invention, there is provided a method for driving a liquid crystal display device performing pause drive in an alternating-voltage drive mode and including a plurality of scanning signal lines, a plurality of data signal lines crossing each of the scanning signal lines, pixel forming portions formed at intersections of the scanning signal lines and the data signal lines, a correction circuit for outputting either a corrected image signal obtained by subjecting an input image signal to a tone emphasizing process for emphasizing a temporal change in the signal or an image signal being the input image signal not subjected to the tone emphasizing process, a scanning signal line driver circuit for sequentially selecting and scanning the scanning signal lines, and a data signal line driver circuit for writing to the data signal lines correction voltages in accordance with the corrected image signal or signal voltages in accordance with the image signal, the method including the steps of:

- outputting the corrected image signal obtained by subjecting the input image signal to the tone emphasizing process for emphasizing the temporal change in the signal to the data signal line driver circuit at least during the first drive frame in a drive period;
- outputting the image signal being the input image signal not subjected to the tone emphasizing process to the data signal line driver circuit during the last drive frame in the drive period;
- writing at least one of first and second correction voltages at least once to the data signal line in accordance with the corrected image signal subjected to an emphasizing correction process, wherein the first correction voltage has a higher absolute value than the signal voltage, and the second correction voltage has a lower absolute value than the signal voltage; and
- writing a signal voltage having the same polarity as the first or second correction voltage, once to the data signal line immediately after the writing of the first or second correction voltage.

Effect of the Invention

In the first aspect of the present invention, the first correction voltage, which has a higher absolute value than the signal voltage, or the second correction voltage, which has a lower absolute value than the signal voltage, is written at least once to the data signal line, and further, the signal voltage, which has the same polarity as the written first or second correction voltage, is written once to the data signal line. Accordingly, it is rendered possible to suppress a luminance change of an image to be displayed, for all grayscale values, regardless of the grayscale value for the input image signal. Thus, image display quality can be improved to such an extent that the viewer barely recognizes flicker.

The second aspect of the present invention eliminates the need to determine whether the grayscale values for the previous and current frames are the same, and hence eliminates the need for the comparator circuit. In addition, since no comparator circuit is provided, the table is only required to store correction values correlated with grayscale values for the current frame, and therefore, can be reduced in memory capacity. Thus, even in the case where a liquid crystal display device produced at low cost is used, it is possible to suppress a luminance change of an image to be displayed, for all grayscale values, regardless of the grayscale value for the input image signal.

In the third aspect of the present invention, when the tone emphasizing process is performed, the adder circuit provided in the correction circuit outputs a corrected image signal, which is obtained by correcting the grayscale value for the input image signal with a correction value provided by the table, and thereafter, the adder circuit outputs the input image signal without correcting the grayscale value. As a result, a luminance change at the time of writing the signal voltages is suppressed significantly, for all grayscale values for the input image signal, so that the viewer barely recognizes flicker.

In the fourth aspect of the present invention, the adder circuit outputs the corrected image signal in each of two or more consecutive drive frames, including the first drive frame. As a result, the liquid crystal display device performs the tone emphasizing process at least twice in succession during the drive period of each pause drive period. Thus, even in the case where the liquid crystal has a slow response speed, liquid crystal molecules can be reliably oriented in the direction of an applied voltage.

In the fifth aspect of the present invention, the table includes the first table for storing correction values for one direction of an applied voltage and the second table for storing correction values for the other direction of the applied voltage. As a result, even if the response speed of the liquid crystal varies depending on the direction of a voltage applied to the liquid crystal layer, a suitable one of the first and second tables is selected so that a decrease in luminance due to the direction of the applied voltage at the time of writing can be kept down to approximately the same level. Thus, the viewer barely recognizes flicker.

In the sixth aspect of the present invention, since flicker is recognizable in the case where the same image continues to be displayed, the adder circuit outputs the corrected image signal, which is obtained by correcting the grayscale value for the input image signal with the correction value provided by the table, only when the grayscale values for the current and previous frames for the input image signal are essentially equal. Accordingly, the tone emphasizing process is performed only when images with essentially the same grayscale value are displayed successively, and thereafter, normal drive is performed. As a result, the viewer barely recognizes flicker. Moreover, the memory capacity of the table can be reduced, resulting in reduced cost for the liquid crystal display device. In addition, in the case where the liquid crystal has a high response speed, and the grayscale values for the previous and current frames are different, only the first drive frame may be set so as to be followed by a pause period rather than by the second drive frame. Setting no second drive frame reduces power consumption by the liquid crystal display device.

In the seventh aspect of the present invention, when the grayscale values for the current and previous frames for the input image signal are essentially not equal, the corrected image signal continues to be outputted without correcting the grayscale value for the input image signal. Thus, even in the case where the liquid crystal has a low response speed, liquid crystal molecules can be reliably oriented in the direction of an applied voltage.

In the eighth aspect of the present invention, the temperature sensor and the sub-tables for storing different correction values for temperatures are provided, and one of the sub-tables is selected depending on the ambient temperature around the liquid crystal display device to perform the tone emphasizing process. Thus, in liquid crystal display devices for use in a wide range of temperatures also, the decrease in luminance at the time of writing the signal voltages can be suppressed so that the viewer barely recognizes flicker.

The ninth aspect of the present invention includes the nonvolatile memory for storing data items for different correction values for predetermined temperature ranges, and the nonvolatile memory provides the table with one of the data items that is selected in accordance with temperature information. As a result, in the case where the liquid crystal display device is used in a wide range of temperatures, the nonvolatile memory has prestored correction values to be stored in a plurality of tables, and transfers data for correction values for a temperature range corresponding to temperature information provided by the temperature sensor. Thus, the number of tables can be reduced, resulting in reduced production cost for the liquid crystal display device.

In the tenth aspect of the present invention, the temperature sensor is provided on the insulating substrate, and provides the temperature information to the timing control circuit via serial communication, and the temperature sensor can be provided in an arbitrary position on the insulating substrate.

In the eleventh aspect of the present invention, the temperature sensor is provided in the timing control circuit, and therefore, the circuit configuration of the timing control circuit does not become complex. Thus, the production cost for the liquid crystal display device can be reduced.

In the twelfth aspect of the present invention, the thin-film transistor used in the pixel forming portion is a thin-film transistor with a channel layer formed of an oxide semiconductor. The thin-film transistor offers very low off-leakage current, and therefore, the voltage written in the pixel forming portion can be maintained for a long period of time. Thus, multitone display can be provided even during pause drive.

In the thirteenth aspect of the present invention, InGaZnO is used as the oxide semiconductor of which the channel layer is formed, so that similar effects to those achieved by the twelfth aspect of the present invention can be reliably achieved.

In the fourteenth aspect of the present invention, the thin-film transistor used in the pixel forming portion is a thin-film transistor with a channel layer formed of an amorphous semiconductor or a polycrystalline semiconductor. Thus, a liquid crystal display device which can be produced at low cost is allowed to display an image, such as a black-and-white image, which can be displayed with two luminance values.

The fifteenth aspect of the present invention allows the liquid crystal display device according to any of the first through fourteenth aspects of the invention to be driven by dot-by dot inversion drive, line-by-line inversion drive, column-by-column inversion drive, or frame-by-frame inversion drive, so that the decrease in luminance due to the writing of the signal voltages can be suppressed significantly. Thus, image display quality can be improved to such an extent that the viewer barely recognizes flicker.

BRIEF DESCRIPTION OF THE DRAWINGS

FIG. 2 is a diagram showing an example of the configuration of an LUT used in the liquid crystal display device shown in FIG. 1.

FIG. 17 is a diagram showing an example of the configuration of an LUT used in the liquid crystal display device shown in FIG. 16.

FIG. 21 is a diagram showing an example of the configuration of an LUT used in the liquid crystal display device according to the first variant shown in FIG. 20.

FIG. 28 is a diagram showing an LUT for room temperature for use in the liquid crystal display device shown in FIG. 27.

FIG. 29 is a diagram showing an LUT for high temperature for use in the liquid crystal display device shown in FIG. 27.

FIG. 30 is a diagram showing an LUT for low temperature for use in the liquid crystal display device shown in FIG. 27.

MODES FOR CARRYING OUT THE INVENTION

1. First Embodiment

<1.1 Configuration of the Liquid Crystal Display Device>

Figure 1:
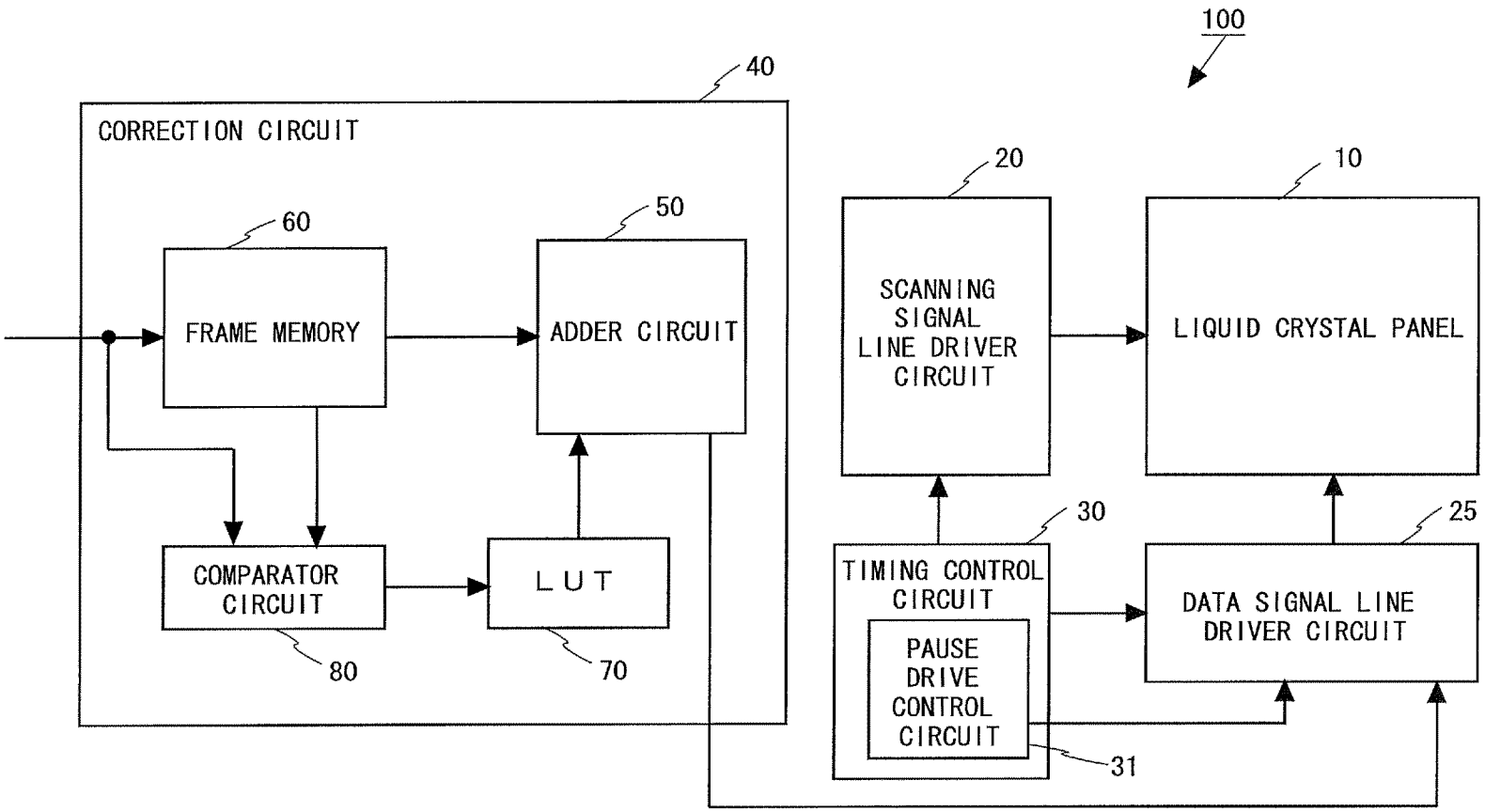
FIG. 1 is a block diagram illustrating the configuration of a liquid crystal display device according to a first embodiment of the present invention.

FIG. 1 is a block diagram illustrating the configuration of a liquid crystal display device 100 according to a first embodiment of the present invention. The liquid crystal display device 100 shown in FIG. 1 includes a liquid crystal panel 10, a scanning signal line driver circuit 20, a data signal line driver circuit 25, a timing control circuit 30, and a correction circuit 40.

The liquid crystal panel 10 has a plurality of pixel forming portions (not shown) arranged in a matrix of rows and columns. Moreover, the liquid crystal panel 10 has a plurality of scanning signal lines (not shown) and a plurality of data signal lines (not shown) formed crossing each other. Each scanning signal line is connected to pixel forming portions arranged in the same row, whereas each data signal line is connected to pixel forming portions arranged in the same column.

A horizontal synchronization signal and a vertical synchronization signal are inputted to the timing control circuit 30 as synchronization signals for an input image signal. On the basis of the synchronization signals, the timing control circuit 30 generates and outputs control signals, such as a gate clock signal and a gate start pulse signal, to the scanning signal line driver circuit 20, and also generates and outputs control signals, such as a source clock signal and a source start pulse signal, to the data signal line driver circuit 25.

Furthermore, the timing control circuit 30 includes a pause drive control circuit 31. The pause drive control circuit 31 outputs an amplifier enable signal to the data signal line driver circuit 25 in synchronization with the generated control signals. As will be described in detail later, the liquid crystal display device 100 sets a drive period in which overshoot voltages (also referred to as "first correction voltages"), undershoot voltages (also referred to as "second correction voltages"), or signal voltages are written to drive the liquid crystal panel 10, as well as a pause period in which the writing of the voltages is paused. In the drive period, the pause drive control circuit 31 activates the amplifier enable signal, thereby causing an analog amplifier (not shown) provided in the data signal line driver circuit 25 to operate. As a result, the overshoot voltages, the undershoot voltages, or the signal voltages can be written to the data signal lines. In the pause period, the amplifier enable signal is deactivated, thereby pausing the analog amplifier. In this manner, the pause drive control circuit 31 can set the drive period and the pause period arbitrarily.

The scanning signal line driver circuit 20 drives the scanning signal lines of the liquid crystal panel 10 in accordance with the control signals generated by the timing control circuit 30, thereby sequentially selecting the scanning signal lines. The data signal line driver circuit 25 converts a corrected image signal outputted by the correction circuit 40 into signal voltages, which are analog voltages, in accordance with the control signals generated by the timing control circuit 30, and writes the signal voltages to the data signal lines. Moreover, overshoot or undershoot voltages, which are generated in a manner to be described later, are written to the data signal lines. In addition, the voltages written to the data signal lines are in turn written to pixel forming portions connected to scanning signal lines that have been selected by applying active scanning signals thereto. Note that the data signal line driver circuit 25 writes the signal voltages, the overshoot voltages, or the undershoot voltages to the data signal lines only when the data signal line driver circuit 25 is receiving an active amplifier enable signal from the pause drive control circuit 31.

The data signal line driver circuit 25 will be described herein as performing dot-by-dot inversion drive to display an image on the liquid crystal panel 10, and therefore, the polarity of signal voltages corresponding to a corrected image signal are controlled in the following manner. Specifically, signal voltages, which are simultaneously applied to the data signal lines, are inverted in polarity every data signal line. Accordingly, any pixel forming portion having a signal voltage of the positive polarity written therein is surrounded by pixel forming portions having signal voltages of the negative polarity written therein, whereas any pixel forming portion having a signal voltage of the negative polarity written therein is surrounded by pixel forming portions having signal voltages of the positive polarity written therein.

The correction circuit 40 outputs a corrected image signal, which is obtained by subjecting an input image signal to a correction for emphasizing a change in the signal, to the data signal line driver circuit 25. The correction circuit 40 includes an adder circuit 50, frame memory 60, a comparator circuit 80, and an LUT 70. The frame memory 60 stores an externally provided input image signal for one frame. The comparator circuit 80 obtains a grayscale value for the externally provided input image signal (i.e., a grayscale value for the current frame) and a grayscale value stored in the frame memory 60 for the input image signal in the immediately previous frame period (i.e., a grayscale value for the previous frame), and provides the results to the LUT 70. The LUT 70 has a plurality of correction values stored therein and correlated with grayscale values for the previous and current frames, as will be described later. When the LUT 70 is provided with grayscale values for the previous and current frames from the comparator circuit 80, the LUT 70 provides a correction value corresponding thereto to the adder circuit 50. Note that the LUT will also be referred to herein as a "table". Moreover, in some cases herein, a signal obtained by the adder circuit 50 adding/subtracting a correction value to/from an input image signal might be referred to as a corrected image signal, and a signal not having been corrected with a correction value might be referred to as an image signal.

The adder circuit 50 is connected to the frame memory 60, so as to be provided with the input image signal stored in the frame memory 60. When overshoot or undershoot voltages are written, the frame memory 60 provides the input image signal to the adder circuit 50 immediately after the signal is stored in the frame memory 60. To write overshoot voltages, the adder circuit 50 generates a corrected image signal by adding a correction value provided by the LUT 70 to the grayscale value for the current frame, and outputs the generated signal to the data signal line driver circuit 25. To write undershoot voltages, the adder circuit 50 generates a corrected image signal by subtracting a correction value from the grayscale value for the current frame, and outputs the generated signal to the data signal line driver circuit 25.

Next, the input image signal stored in the frame memory 60 is provided to the adder circuit 50 again. The input image signal is the same input image signal as that used for generating the corrected image signal. The adder circuit 50 outputs the grayscale value for the current frame to the data signal line driver circuit 25 as an image signal without correction.

FIG. 2 is a diagram showing an example of the configuration of the LUT 70 for use in the liquid crystal display device 100. The LUT 70 has stored therein correction values for emphasizing temporal changes in input image signals, such that the correction values are correlated with combinations of grayscale values for the previous and current frames, as shown in FIG. 2. For example, in the case where the grayscale value for the previous frame is 32, and the grayscale value for the current frame is 160, their corresponding correction value is 6 in the LUT 70. When the LUT 70 provides this correction value to the adder circuit 50, the adder circuit 50 generates a corrected image signal with the grayscale value "166" by adding the correction value "6" to the grayscale value "160" for an input image signal provided by the frame memory 60 (i.e., the grayscale value for the current frame), and outputs the generated signal to the data signal line driver circuit 25. The data signal line driver circuit 25 obtains overshoot voltages corresponding to the corrected image signal, and writes them to the data signal lines SL. In this manner, overshoot drive is performed.

Furthermore, the LUT 70 also has negative correction values stored therein. More specifically, they are for the grayscale values "224" and "255" for both of the previous and current frames. For example, in the case where both the grayscale value for the previous frame and the grayscale value for the current frame are 224, their corresponding correction value is −2 in the LUT 70. The LUT 70 provides the correction value to the adder circuit 50, so that the adder circuit 50 generates a corrected image signal with the grayscale value "222" by subtracting 2 from the grayscale value "224" for the input image signal provided by the frame memory 60 (i.e., the grayscale value for the current frame), and outputs the generated signal to the data signal line driver circuit 25. The data signal line driver circuit 25 obtains undershoot voltages corresponding to the corrected image signal, and writes the obtained voltages to the data signal lines SL. In this manner, undershoot drive is performed. Moreover, in the case where both the grayscale value for the previous frame and the grayscale value for the current frame are 192, their corresponding correction value is 0, and therefore, neither overshoot drive nor undershoot drive is performed.

Figure 35:
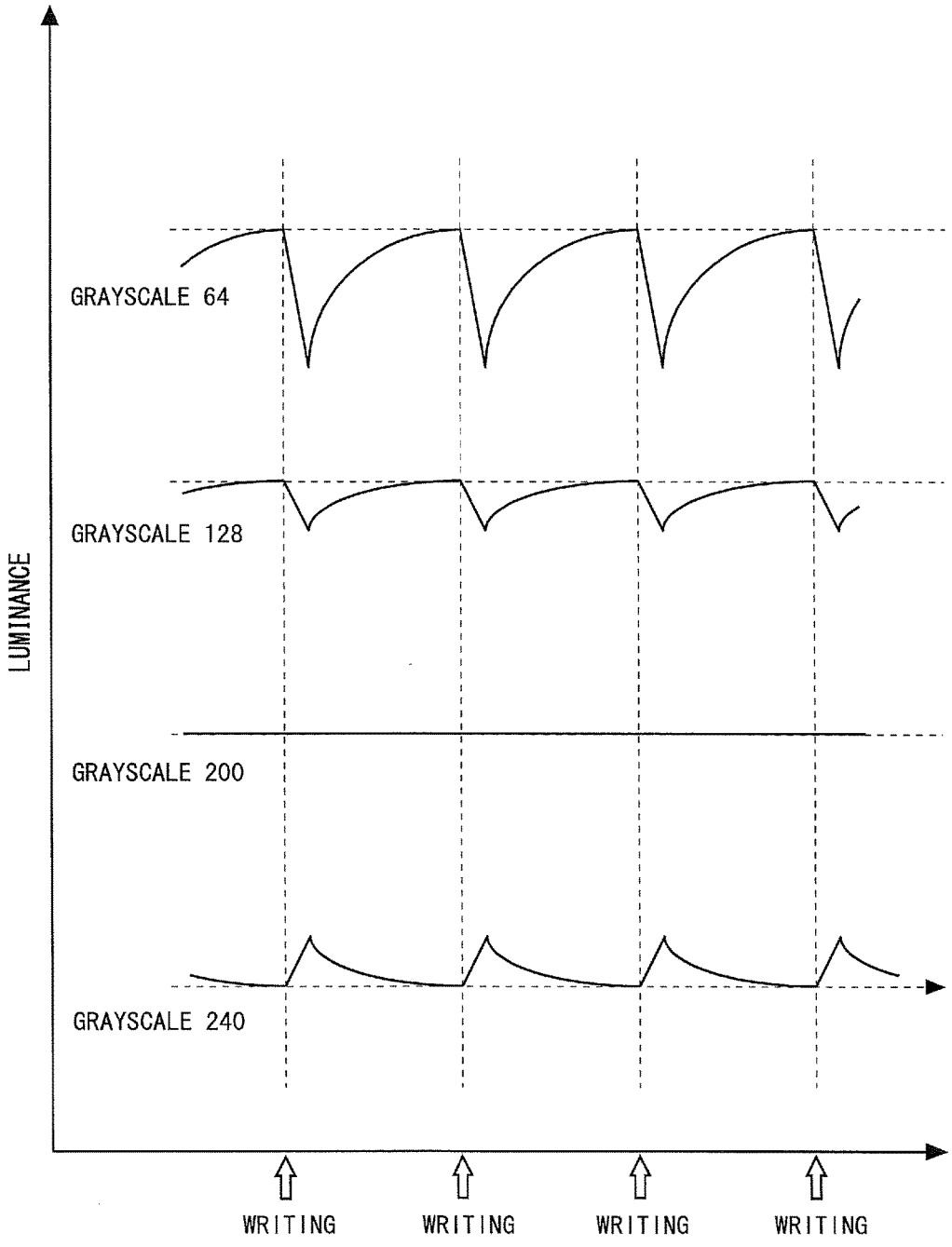
FIG. 35 is a diagram schematically illustrating luminance changes where input image signals that correspond to the grayscale values "64", "128", "200", and "240" are written in pixel forming portions by conventional pause drive in an alternating-voltage drive mode.
Figure 36:
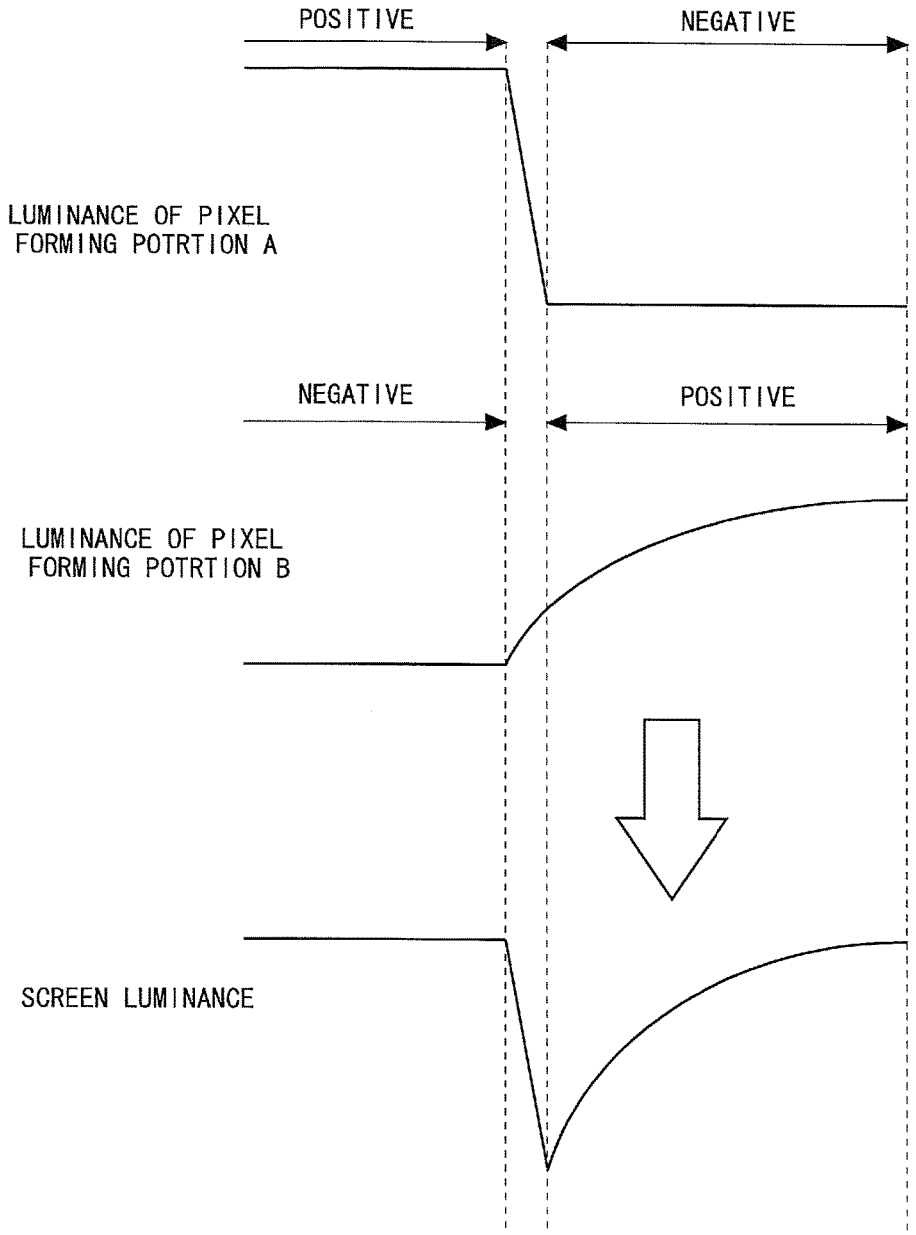
FIG. 36 is a diagram describing luminance changes where an input image signal with the grayscale value "64" is written by conventional pause drive in an alternating-voltage drive mode.
Figure 37:
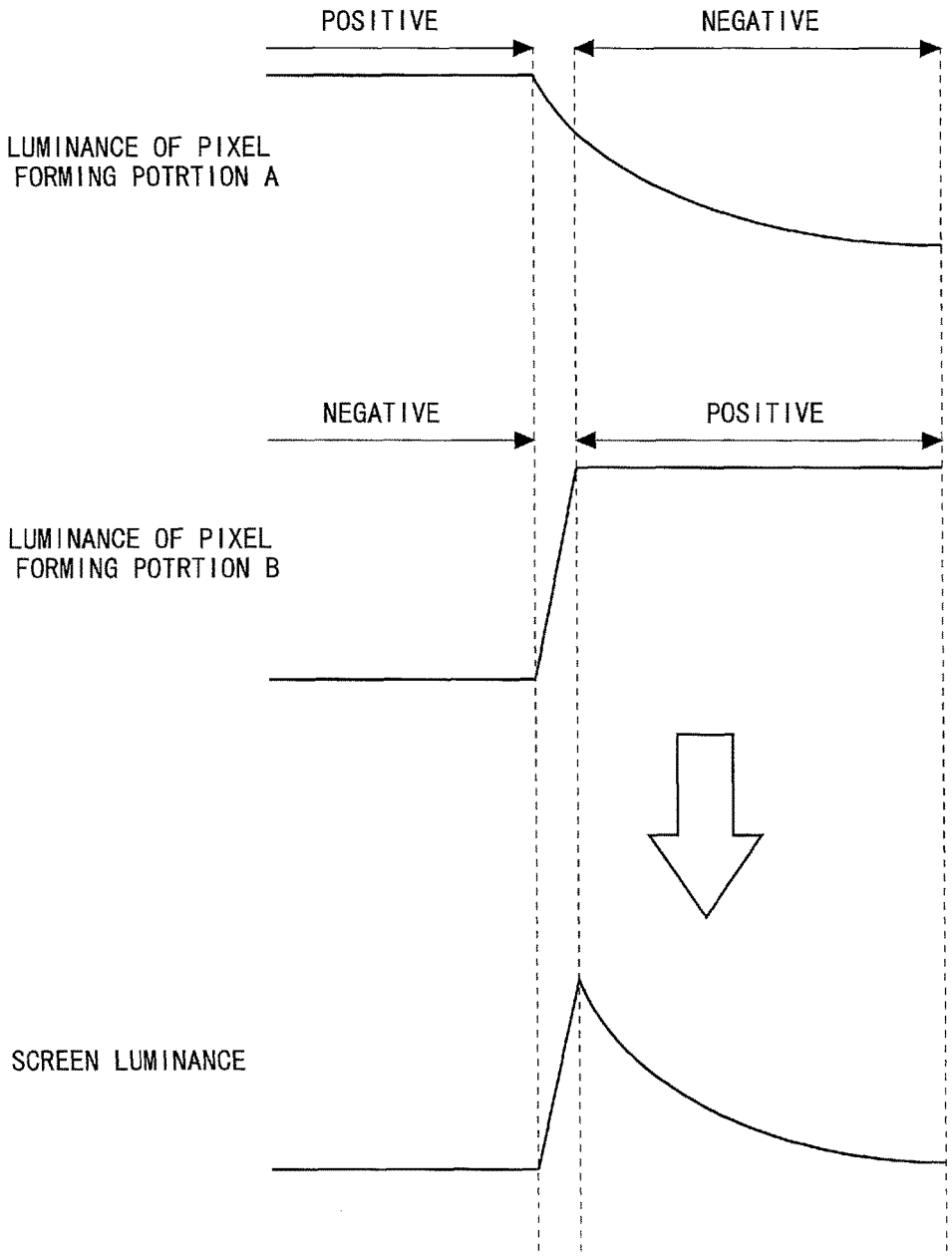
FIG. 37 is a diagram describing luminance changes where an input image signal with the grayscale value "240" is written by conventional pause drive in an alternating-voltage drive mode.

In this manner, when the correction value stored in the LUT 70 is positive, overshoot drive is performed, and when the value is negative, undershoot drive is performed. When both the grayscale values for the previous and current frames are low, the screen luminance drops every pause drive period, and thereafter gradually returns to its original level, as shown in FIG. 35. When both the grayscale values for the previous and current frames are high, the screen luminance rises every pause drive period, and gradually drops thereafter. Accordingly, to cancel out such luminance changes, the LUT 70 has high positive values stored as correction values for low grayscale values for the previous and current frames, as well as negative or low positive values as correction values for high grayscale values for the previous and current frames.

Note that the liquid crystal display device 100 is assumed herein to be a display device adapted for display with 256 grayscale values, and therefore, the LUT 70 is correspondingly assumed to have grayscale values in the grayscale range from 0 to 255 stored therein. However, the number of grayscale values for the liquid crystal display device to which the present invention can be applied is not limited to 256, and may be greater or less than 256. In such a case, the number of correction values to be stored in the LUT also increases or decreases in accordance with the number of grayscale values for the liquid crystal display device.

Furthermore, to save memory capacity, the LUT 70 shown in FIG. 2 lists the grayscale values for the previous and current frames approximately at intervals of 32 grayscale levels. The method for obtaining correction values that correspond to grayscale values for the previous and current frames but are not stored in the LUT 70 using the LUT 70 will thus be described. The simplest approach is to process not only the grayscale values stored in the LUT 70 but also any grayscale values in the range of approximately ±16 with respect to the stored values, considering these values to be stored in the LUT 70 as well. For example, any grayscale value in the range of from 177 (=192−16+1) to 208 (=192+16) is processed as the grayscale value "192". Also, any grayscale value in the range of from 209 (=224−16+1) to 240 (=224+16) is processed as the grayscale value "224". More specifically, when the grayscale value for the previous frame is 200, and the grayscale value for the current frame is 220, the correction value is 5, which corresponds to the grayscale value "192" for the previous frame and also the grayscale value "224" for the current frame. In addition, when a more accurate correction value is desired to be obtained, linear interpolation may be used. Note that linear interpolation is a well-known interpolation method, and therefore, any detailed description thereof will be omitted.

<1.2 Configuration of the Pixel Forming Portion>

Figure 3:
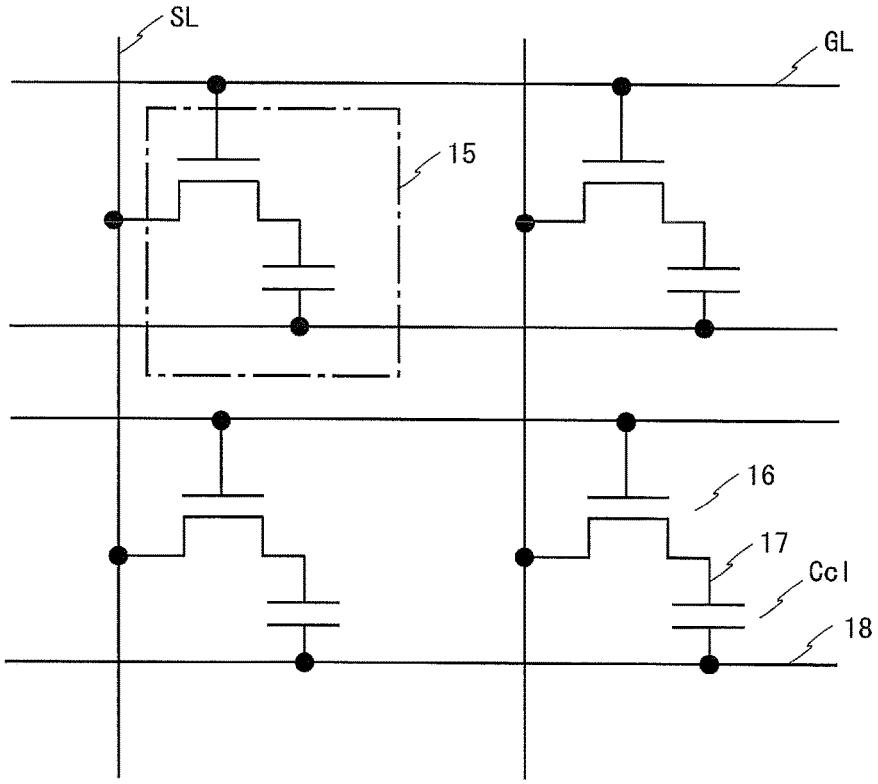
FIG. 3 is a diagram illustrating equivalent circuits of pixel forming portions included in the liquid crystal display device shown in FIG. 1.

FIG. 3 is a diagram illustrating equivalent circuits of pixel forming portions 15 included in the liquid crystal display device 100. As shown in FIG. 3, each pixel forming portion 15 includes a TFT 16 having a gate terminal, which serves as a control terminal, connected to a scanning signal line GL passing through a corresponding intersection, and a source terminal, which serves as a first conductive terminal, connected to a data signal line SL passing through the intersection, a pixel electrode 17 connected to a drain terminal of the TFT 16, which serves as a second conductive terminal, a common electrode 18 provided commonly for the pixel forming portions 15, and a liquid crystal layer (not shown) provided commonly for the pixel forming portions 15 between the pixel electrode 17 and the common electrode 18. Liquid crystal capacitance Ccl is formed by the pixel electrode 17 and the common electrode 18 and serves as pixel capacitance. A voltage applied to the common electrode 18 is generated by a common voltage generating circuit (not shown). Note that it is often the case that auxiliary capacitance is provided parallel to the liquid crystal capacitance Ccl in order to reliably maintain the voltage in the pixel capacitance, but the pixel capacitance will be described herein as being formed solely by the liquid crystal capacitance Ccl.

The TFT 16 shown in FIG. 3 functions as a switching element, which is turned on to write a signal voltage in the liquid crystal capacitance Ccl or turned off to maintain the signal voltage in the liquid crystal capacitance Ccl. For example, a TFT with an oxide semiconductor used in a channel layer (referred to below as an "oxide TFT") is used as a TFT 16. More specifically, the channel layer of the TFT 16 is formed of InGaZnO, which is mainly composed of indium (In), gallium (Ga), zinc (Zn), and oxygen (O). In the following, such a TFT with InGaZnO used in a channel layer will be referred to as an "IGZO-TFT".

Figure 4:
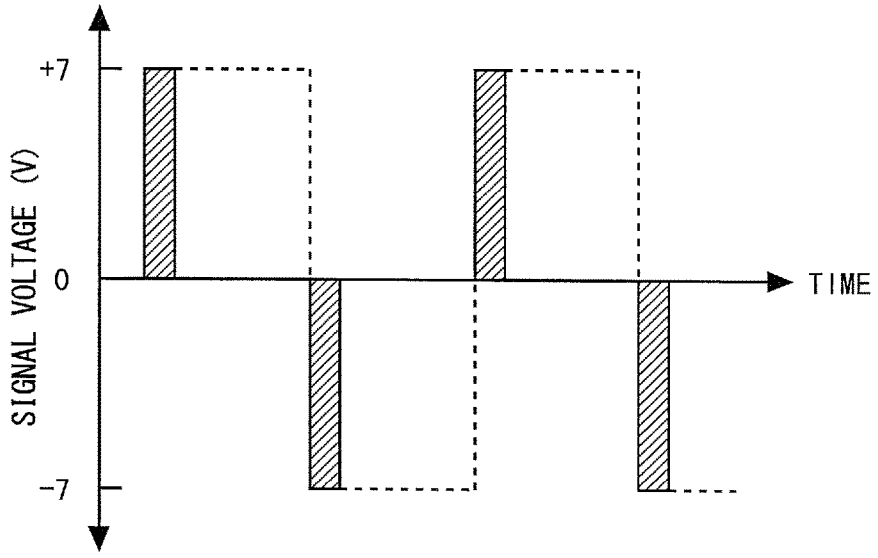
FIG. 4 is a diagram showing temporal changes in a signal voltage written in liquid crystal capacitance where IGZO-TFTs are used as switching elements of the pixel forming portions in the liquid crystal display device shown in FIG. 1.

FIG. 4 is a diagram showing temporal changes in a signal voltage written in the liquid crystal capacitance Ccl where IGZO-TFTs 16 are used as the switching elements of the pixel forming portions 15 in the liquid crystal display device 100. As shown in FIG. 4, a signal voltage of the positive polarity (e.g., +7V) is written, and the written voltage is maintained for a predetermined period of time. Next, a signal voltage of the negative polarity (e.g., −7V) is written, and the written voltage is maintained for a predetermined period of time. Even after these operations are repeated, the signal voltage written in the liquid crystal capacitance Ccl barely changes. Accordingly, it can be appreciated that the IGZO-TFT 16 offers extremely low off-leakage current, and the signal voltage written in the liquid crystal capacitance Ccl is maintained for a long period of time. In this manner, by using the IGZO-TFT 16 as the switching element of the pixel forming portion 15, it is rendered possible to perform multi-tone display even during pause drive.

Note that similar effects can be achieved even in the case where an oxide semiconductor, other than InGaZnO, which includes, for example, at least one of the following: indium; gallium; zinc; copper (Cu); silicon (Si); tin (Sn); aluminum (Al); calcium (Ca); germanium (Ge); and lead (Pb), is used in a channel layer.

<1.3 Operation During Pause Drive>

Figure 5:
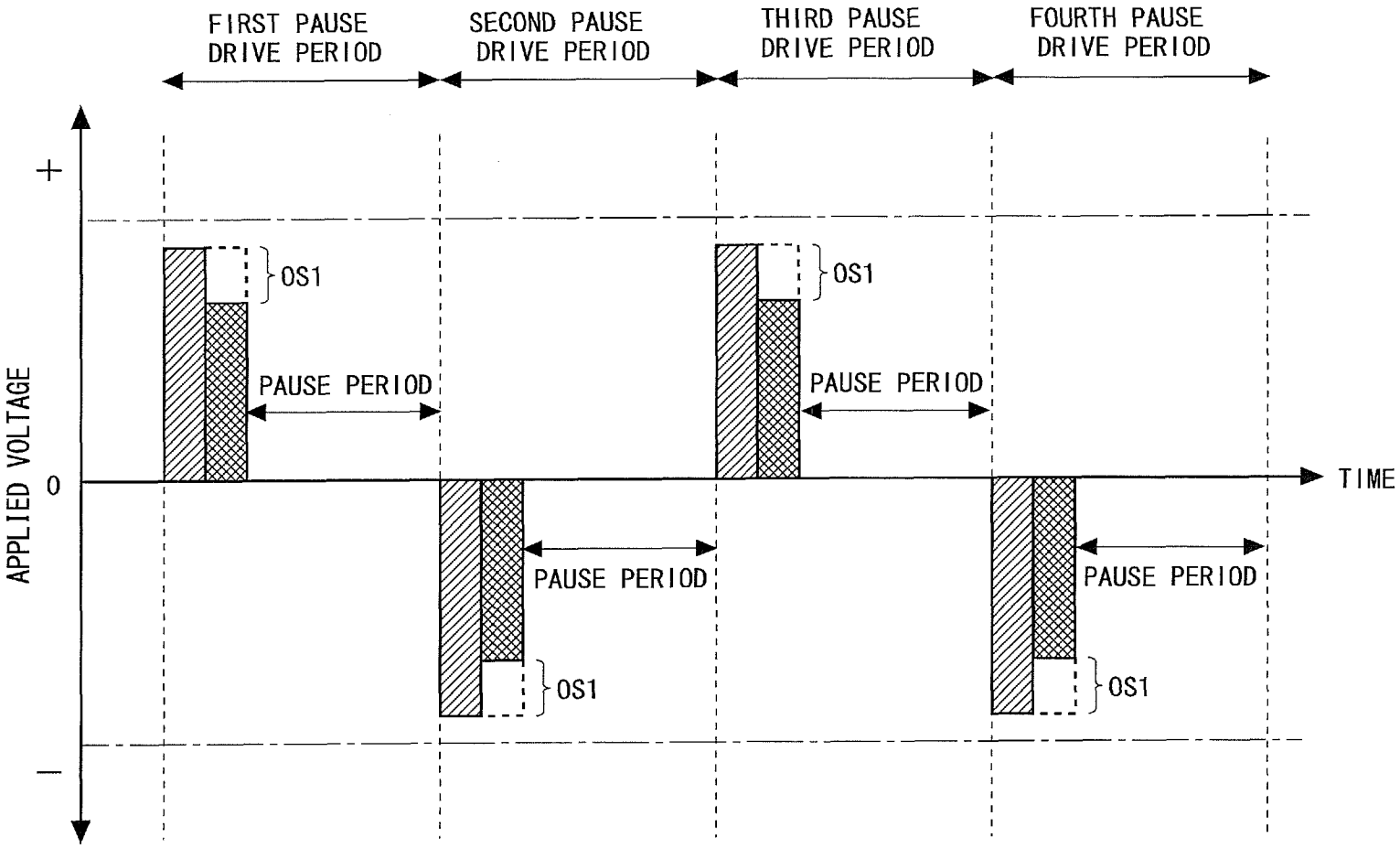
FIG. 5 is a diagram describing pause drive, incorporating overshoot drive, in the liquid crystal display device shown in FIG. 1.
Figure 6:
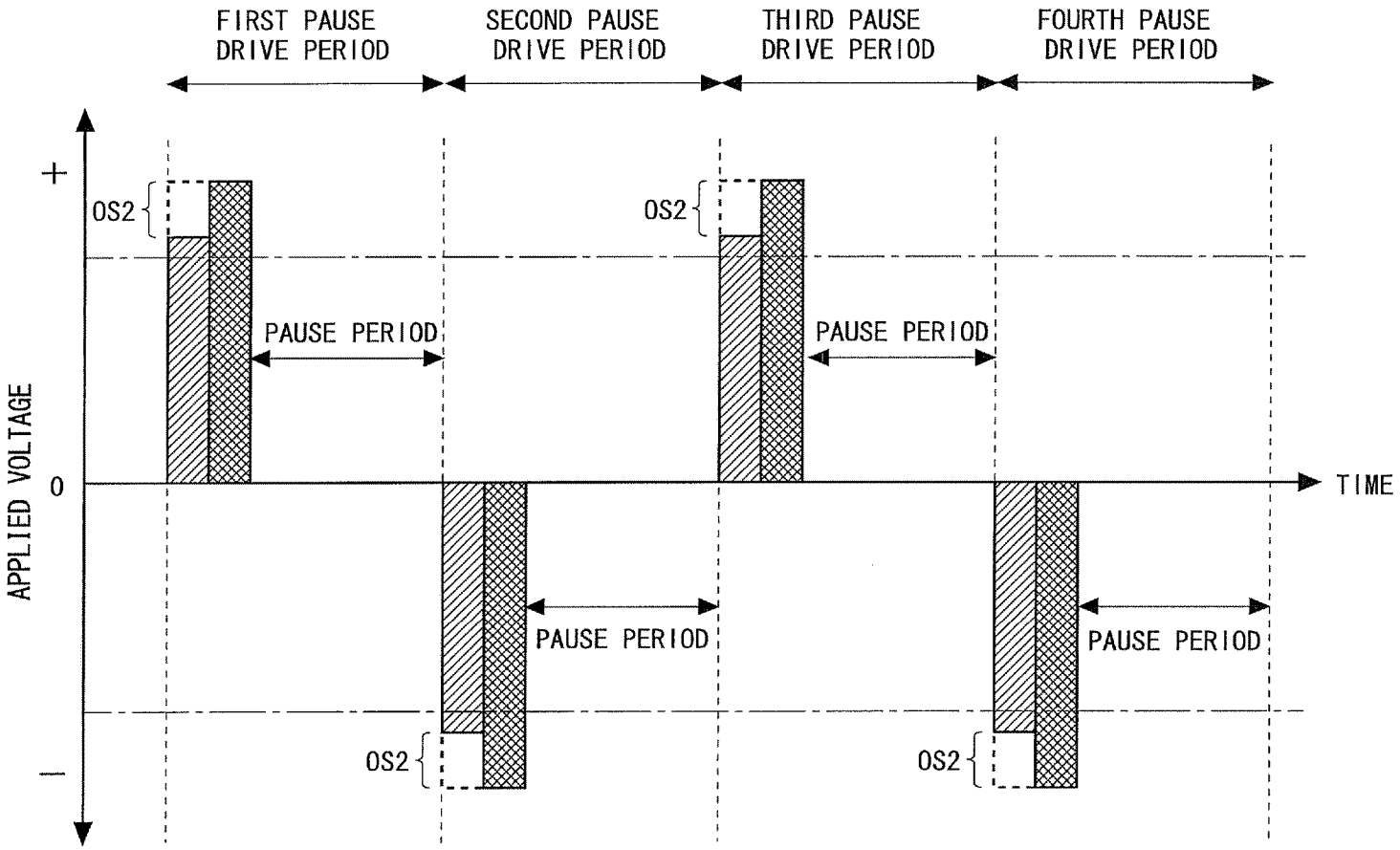
FIG. 6 is a diagram describing pause drive, incorporating undershoot drive, in the liquid crystal display device shown in FIG. 1.

FIG. 5 is a diagram describing pause drive, incorporating overshoot drive, in the liquid crystal display device 100, and FIG. 6 is a diagram describing pause drive, incorporating undershoot drive, in the liquid crystal display device 100. The liquid crystal display device 100 repeats the drive period and the pause period alternatingly, thereby driving the liquid crystal panel 10. In the drive period, the pause drive control circuit 31 outputs an active amplifier enable signal to the data signal line driver circuit 25, and overshoot voltages and signal voltages are written to the data signal lines SL. In the pause period, the pause drive control circuit 31 outputs an inactive amplifier enable signal to the data signal line driver circuit 25, thereby stopping the operation of the data signal line driver circuit 25 and/or the scanning signal line driver circuit 20.

Note that within each drive period shown in FIGS. 5 and 6, a period in which overshoot voltages are written will be referred to herein as a first drive period, and a period in which signal voltages are written will be referred to herein as a second drive period. Moreover, frames for these drive periods are referred to as first and second drive frames, respectively, and a frame for the pause period will be referred to as a pause frame. In addition, within each drive period shown in FIG. 6, a period in which undershoot voltages are written will be referred to herein as a third drive period, and a period in which signal voltages are written will be referred to herein as a fourth drive period. Moreover, frames for these drive periods are referred to as third and fourth drive frames, respectively, and a frame for the pause period will be referred to as a pause frame. The overshoot voltage, the undershoot voltage, and the signal voltage might be referred to simply as voltages when they are not distinguished.

As shown in FIGS. 5 and 6, the drive period and the pause period are set so as to alternate with each other, and one drive period and an immediately succeeding pause period are collectively referred to as a pause drive period. The polarity of signal voltages written to the data signal lines SL is inverted every pause drive period. Accordingly, the polarity of the voltages is positive during odd pause drive periods and negative during even pause drive periods. Moreover, the grayscale value for the input image signal is constant during each pause drive period. This is because it is taken into consideration that the images displayed on the liquid crystal panel 10 by pause drive are mostly still images. Note that the present embodiment is not limited to still images, and any images suitable for pause drive may be displayed. In such a case, the grayscale value for the input image signal is not necessarily constant during each pause drive period.

Furthermore, in FIGS. 5 and 6, two, upper and lower, long-dashed short-dashed lines drawn parallel to the time axis are lines (boundary lines) that indicate the boundaries between overshoot drive and undershoot drive; undershoot drive is performed in the case where the grayscale values for the previous and current frames are equal and have the absolute value that corresponds to an applied voltage above the upper boundary line or below the lower boundary line, and overshoot drive is performed in all other cases. In the present embodiment, the long-dashed short-dashed lines represent applied voltages that correspond to the grayscale value "224" in the LUT 70 for both the previous and current frames. The grayscale value "224" in such a case might be referred to as the "boundary value".

In FIG. 5, the first and second drive frames are set consecutively within a drive period of the first pause drive period. In the first drive frame, the comparator circuit 80 obtains a grayscale value for an externally provided input image signal (i.e., a grayscale value for the current frame) and a grayscale value stored in the frame memory 60 for an input image signal provided during the immediately previous frame period (i.e., a grayscale value for the previous period), and provides the results to the LUT 70. The LUT 70 outputs a correction value, which is correlated with the combination of the grayscale values for the previous and current frames, to the adder circuit 50. In this case, the absolute value of the grayscale value for the current frame is less than the boundary value, and therefore, the correction value outputted by the LUT 70 is positive. The adder circuit 50 adds the correction value provided by the LUT 70 to the grayscale value for the current frame provided by the frame memory 60, thereby generating a corrected image signal, and outputs the generated signal to the data signal line driver circuit 25. The corrected image signal is converted to overshoot voltages, which are higher than a voltage corresponding to the input image signal by the correction value (denoted by "OS1" in FIG. 5), and the overshoot voltages are written to the data signal lines SL. The polarity of the overshoot voltages is positive. As a result, overshoot drive is performed during the first pause drive period.

In the second drive frame, the frame memory 60 has stored therein the same input image signal as that used in the first drive frame. The frame memory 60 provides the input image signal stored therein to the adder circuit 50. The adder circuit 50 outputs the provided input image signal to the data signal line driver circuit 25 as an image signal without addition of a correction value. The image signal is written to the data signal lines SL after conversion to analog signal voltages, which are voltages corresponding to the input image signal. Such drive as above is referred to herein as "normal drive". The polarity of the signal voltages is also positive. As a result, an image desired to be displayed during the first pause drive period is displayed on the liquid crystal panel 10.

In this manner, during the first drive frame, overshoot drive is performed using a correction value provided by the LUT 70, and during the immediately succeeding second drive frame, normal drive is performed so that signal voltages of the positive polarity are written to the data signal lines SL. Thereafter, a pause period in which an image corresponding to the signal voltages written by normal drive is displayed continues until the start of the first drive period in the second pause drive period.

The first and second drive frames are set consecutively also within each drive period of the second pause drive period. In this case, since the absolute value of the grayscale value for the current frame is less than the boundary value, as in the first pause drive period, overshoot drive is performed during the first drive frame using a correction value provided by the LUT 70, and normal drive is performed during the second drive frame. However, unlike in the first pause drive period, the polarities of both the overshoot voltage and the signal voltage are negative during the first and second drive frames. Thereafter, a pause period in which an image corresponding to the signal voltages written by normal drive is displayed continues until the start of the first drive period in the third pause drive period.

Thereafter, similarly, in each odd pause drive period, overshoot drive is performed by writing overshoot voltages of the positive polarity during the first drive frame. Then, normal drive is performed by writing signal voltages of the positive polarity during the second drive frame, and followed by a pause period. Moreover, in each even pause drive period, overshoot drive is performed by writing overshoot voltages of the negative polarity during the first drive frame. Then, normal drive is performed by writing signal voltages of the negative polarity during the second drive frame, and followed by a pause period.

Furthermore, in FIG. 6, the third and fourth drive frames are set consecutively within a drive period of the first pause drive period. In the third drive frame, the comparator circuit 80 obtains a grayscale value for an externally provided input image signal (i.e., a grayscale value for the current frame) and a grayscale value stored in the frame memory 60 for an input image signal provided during the immediately previous frame period (i.e., a grayscale value for the previous period), and provides the results to the LUT 70. The LUT 70 outputs a correction value, which is correlated with the combination of the grayscale values for the previous and current frames, to the adder circuit 50. In this case, the absolute value of the grayscale value for the current frame is equal to the absolute value of the grayscale value for the previous frame and also less than the boundary value, and therefore, the correction value outputted by the LUT 70 is negative. The adder circuit 50 subtracts the correction value from the grayscale value for the current frame provided by the frame memory 60, thereby generating a corrected image signal, and outputs the generated signal to the data signal line driver circuit 25. The corrected image signal is converted to undershoot voltages, which are lower than a voltage corresponding to the input image signal by the correction value (denoted by "OS2" in FIG. 6), and the undershoot voltages are written to the data signal lines SL. The polarity of the undershoot voltages is positive. As a result, undershoot drive is performed during the first pause drive period.

In the fourth drive frame, the frame memory 60 has stored therein the same input image signal as that used in the third drive frame. The frame memory 60 provides the input image signal stored therein to the adder circuit 50. The adder circuit 50 outputs the provided input image signal to the data signal line driver circuit 25 as an image signal without subtraction of a correction value. The image signal is written to the data signal lines SL after conversion to analog signal voltages, which are voltages corresponding to the input image signal. The polarity of the signal voltages is also positive. As a result, an image desired to be displayed during the first pause drive period is displayed on the liquid crystal panel 10.

In this manner, during the third drive frame, undershoot drive is performed using a correction value provided by the LUT 70, and during the immediately succeeding fourth drive frame, normal drive is performed so that signal voltages of the positive polarity are written to the data signal lines SL. Thereafter, a pause period in which an image corresponding to the signal voltages written by normal drive is displayed continues until the start of the first drive period in the second pause drive period.

The third and fourth drive frames are set consecutively also within each drive period of the second pause drive period. In this case, since the absolute value of the grayscale value for the current frame is equal to the absolute value of the grayscale value for the previous frame and also greater than the boundary value, as in the first pause drive period, undershoot drive is performed during the third drive frame using a correction value provided by the LUT 70, and normal drive is performed during the fourth drive frame. However, unlike in the first pause drive period, the polarities of both the undershoot voltage and the signal voltage are negative during the third and fourth drive frames. Thereafter, a pause period in which an image corresponding to the signal voltages written by normal drive is displayed continues until the start of the first drive period in the third pause drive period.

Thereafter, similarly, in each odd pause drive period, undershoot drive is performed by writing undershoot voltages of the positive polarity during the third drive frame. Then, normal drive is performed by writing signal voltages of the positive polarity during the fourth drive frame, and followed by a pause period. Moreover, during each even pause drive period, undershoot drive is performed by writing undershoot voltages of the negative polarity during the third drive frame. Then, normal drive is performed by writing signal voltages of the negative polarity during the fourth drive frame, and followed by a pause period.

Figure 7:
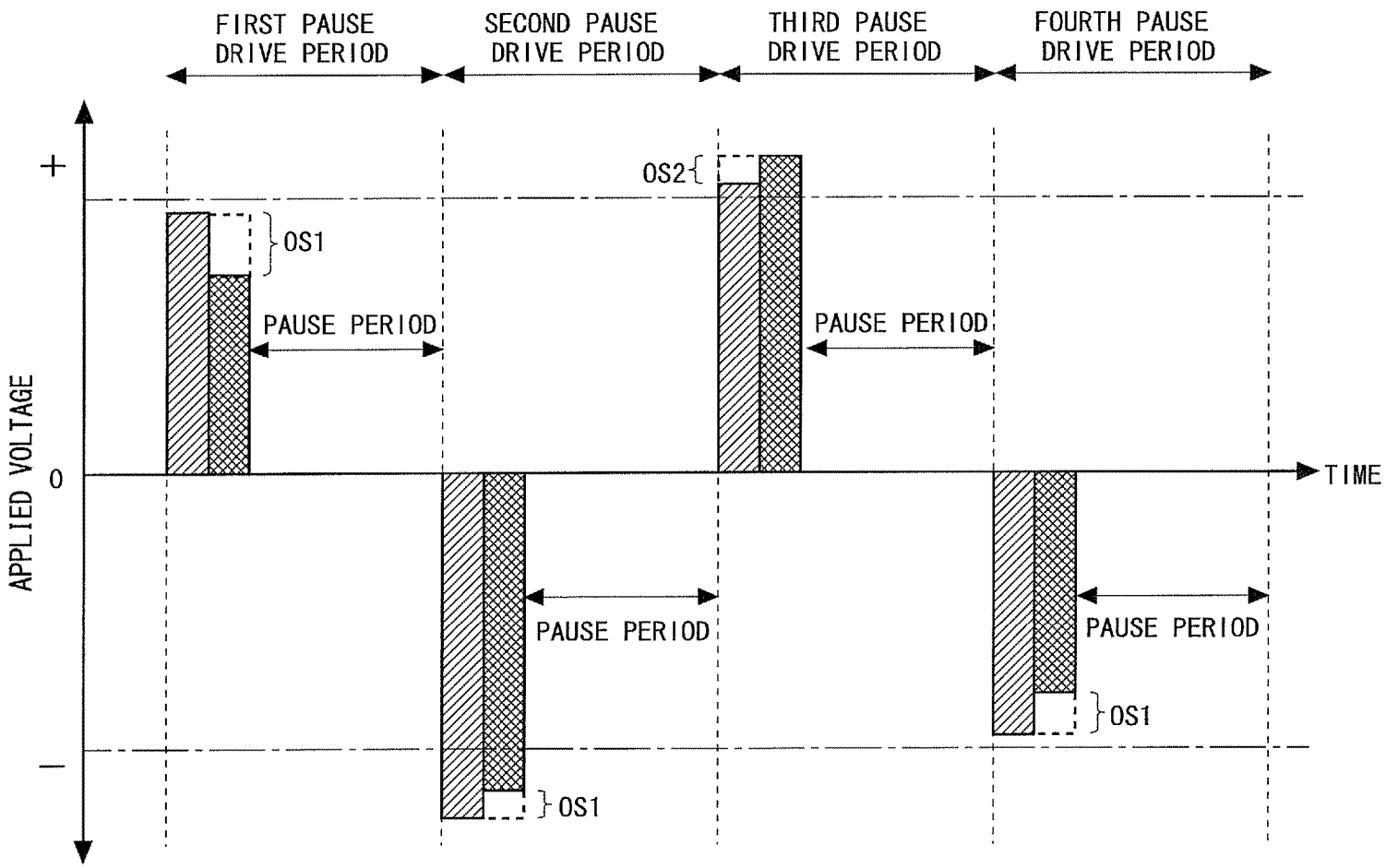
FIG. 7 is a diagram describing pause drive in the liquid crystal display device shown in FIG. 1 where grayscale values for previous and current frames might differ.

FIG. 7 is a diagram describing pause drive in the liquid crystal display device 100 where the grayscale values for the previous and current frames might differ. First, the first pause drive period will be described. During the first drive frame, the absolute value of the grayscale value for the current frame is less than the boundary value, and therefore, overshoot drive is performed using overshoot voltages of the positive polarity generated with addition of a correction value provided by the LUT 70. During the second drive frame, normal drive is performed using analog signal voltages of the positive polarity generated without correcting the grayscale value for the current frame.

During the second pause drive period, the absolute value of the grayscale value for the current frame is greater than the boundary value but differs from the absolute value of the grayscale value for the input image signal during the first pause drive period (i.e., the grayscale value for the previous frame). Accordingly, overshoot drive for the negative polarity is performed during the first drive frame. Then, normal drive for the negative polarity is used during the second drive frame.

During the third pause drive period, the absolute value of the grayscale value for the current frame is greater than the boundary value and also equal to the absolute value of the grayscale value for the input image signal during the second pause drive period (i.e., the grayscale value for the previous frame). Accordingly, undershoot drive for the positive polarity is performed during the first drive frame, and then, normal drive for the positive polarity is performed during the second drive frame. Moreover, during the fourth pause drive period, the absolute value of the grayscale value for the current frame is less than the boundary value, so that overshoot drive for the negative polarity is performed during the first drive frame, and then, normal drive for the negative polarity is performed during the second drive frame.

<1.4 Effects>

Figure 8:
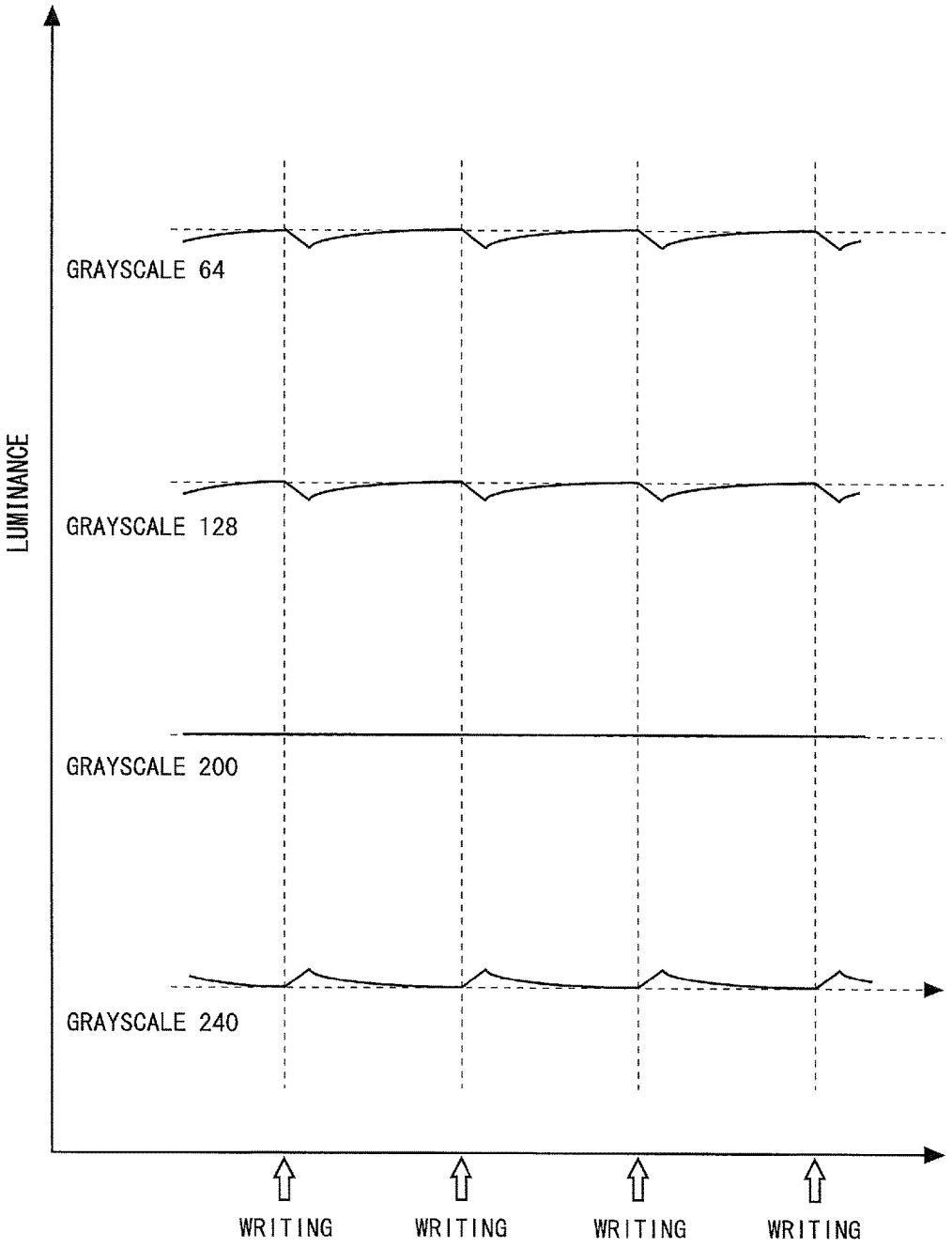
FIG. 8 is a diagram schematically illustrating luminance changes where pause drive is performed in the liquid crystal display device shown in FIG. 1.

FIG. 8 is a diagram schematically illustrating luminance changes where pause drive is performed in the liquid crystal display device 100. As described in conjunction with FIG. 35, in the case of an input image signal with the grayscale value "64", the luminance sharply drops immediately after signal voltages are written in the pixel forming portions, and thereafter slowly returns to its original level. Contrastingly, in the case of an input image signal with the grayscale value "240", the luminance sharply rises immediately after signal voltages are written in the pixel forming portions, and slowly drops thereafter. However, as has been described in the present embodiment, overshoot drive or undershoot drive is performed depending on the grayscale value for the input image signal. As a result, the luminance neither sharply drops for the grayscale values "64" and "128" nor sharply rises for the grayscale value "240", so that for any grayscale value, the luminance of an image to be displayed is inhibited from changing. This improves the quality of an image displayed on the liquid crystal panel 10 to such an extent that the viewer barely recognizes flicker.

Note that normal drive is performed after overshoot or undershoot drive, and therefore, the signal voltages written to the data signal lines SL at the end of the drive period have voltage values corresponding to the input image signal. This allows the liquid crystal display device 100 to always display an image in accordance with the input image signal. Moreover, the IGZO-TFT 16, which offers very low off-leakage current, is used as the switching element of the pixel forming portion 15. Accordingly, the luminance that has dropped immediately after the writing of the signal voltages returns to its original level in the following pause period.

<1.5 First Variant>

In the above embodiment, both overshoot drive and normal drive or both undershoot drive and normal drive are performed once every drive period, and they are performed in succession. However, three or more drive frames may be set to extend the drive period so that overshoot or undershoot drive is performed more than once, and thereafter, normal drive is performed once.

Figure 9:
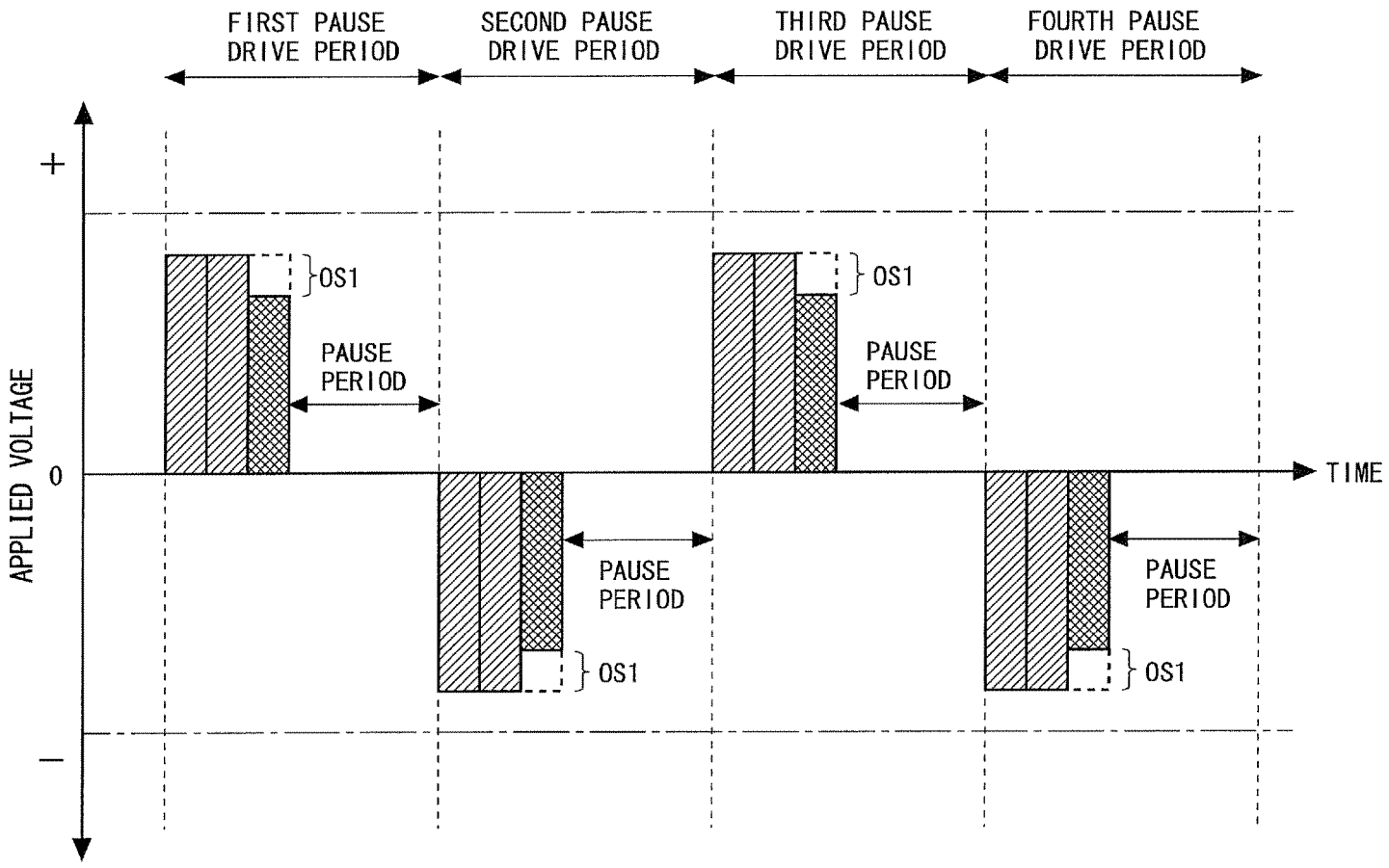
FIG. 9 is a diagram describing pause drive in a first variant of the first embodiment where overshoot drive is performed twice.

The configuration of a liquid crystal display device according to a first variant of the present embodiment is the same as that shown in FIG. 1, and therefore, a block diagram and descriptions thereof will be omitted. FIG. 9 is a diagram describing pause drive in the present variant. As shown in FIG. 9, overshoot drive is performed twice in succession during a drive period in a first pause drive period, and then, normal drive is performed once.

Figure 10:
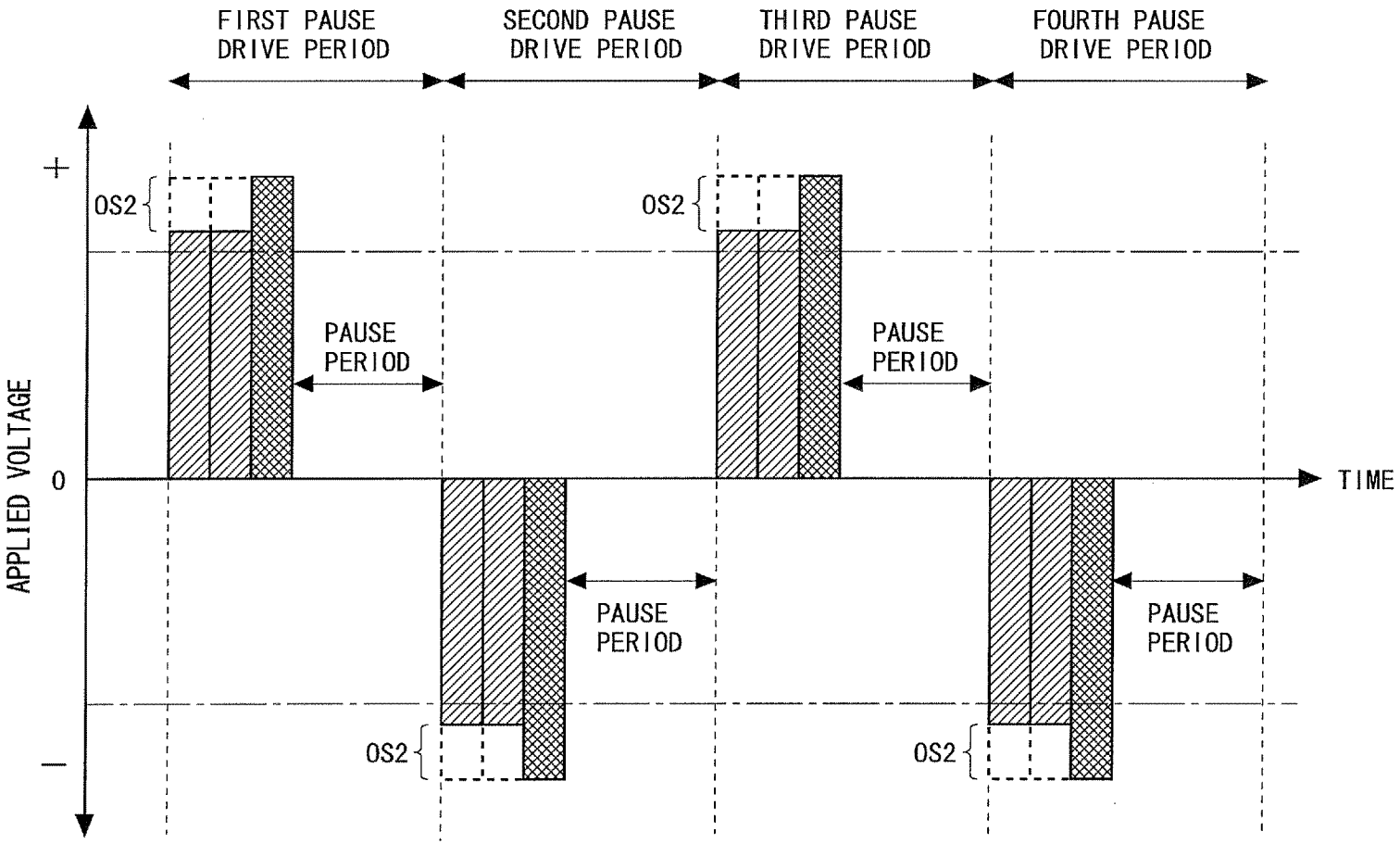
FIG. 10 is a diagram describing pause drive in the first variant of the first embodiment where undershoot drive is performed twice.

In this manner, overshoot drive is performed twice in succession during a drive period within each pause drive period, and therefore, even in the case of liquid crystals with a slow response speed, liquid crystal molecules can be reliably oriented in the same direction as applied voltages. Moreover, undershoot drive may be performed twice in succession and followed by a single performance of normal drive, as shown in FIG. 10. The effects achieved in such a case are the same as those achieved in the case shown in FIG. 9, and therefore, any descriptions thereof will be omitted.

In the present variant, both overshoot drive and undershoot drive are set to be performed twice, but they may be performed three or more times if the response speed of the liquid crystal is slower.

Figure 11:
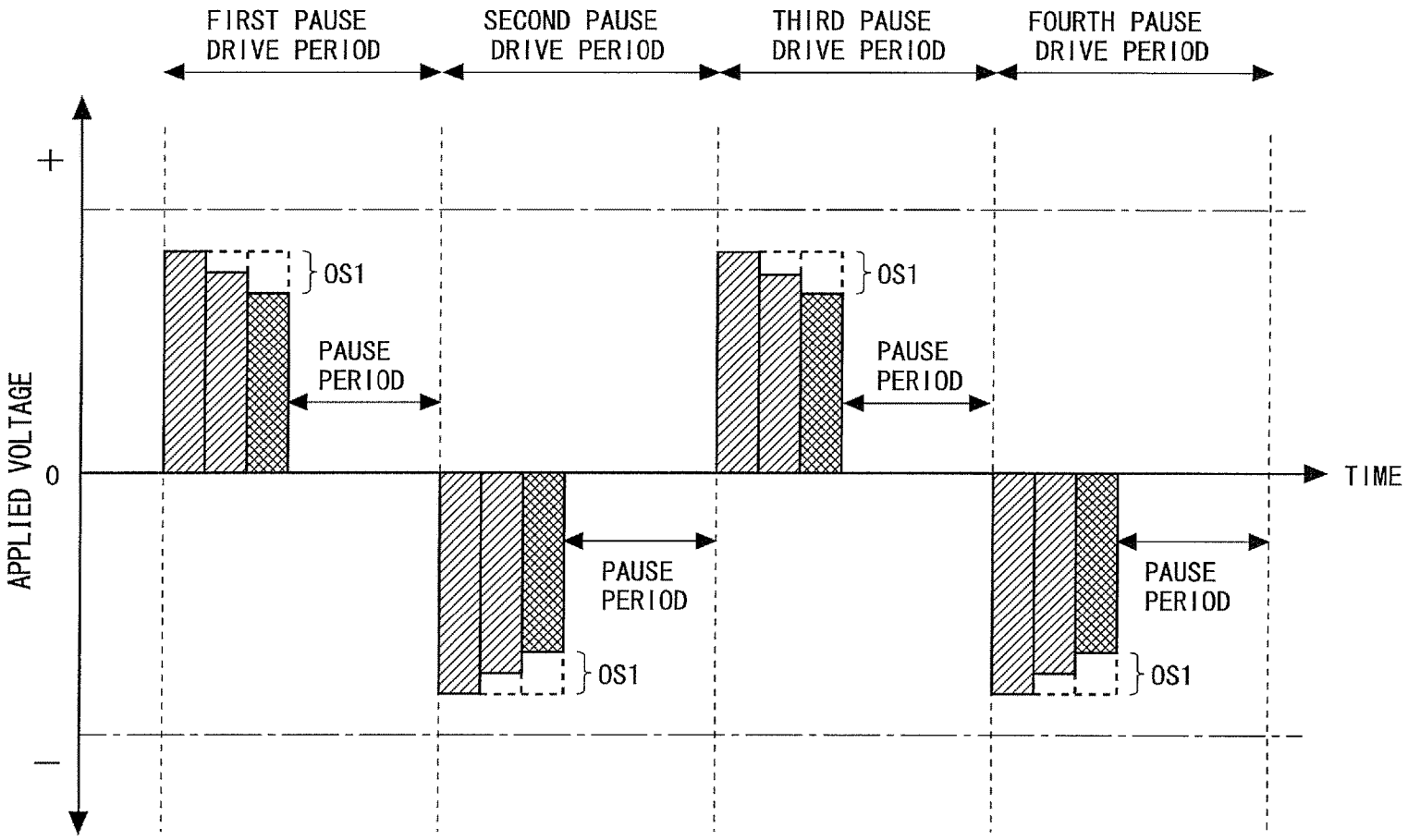
FIG. 11 is a diagram describing pause drive, incorporating overshoot drive, in the first variant of the first embodiment where voltage values decrease gradually.
Figure 12:
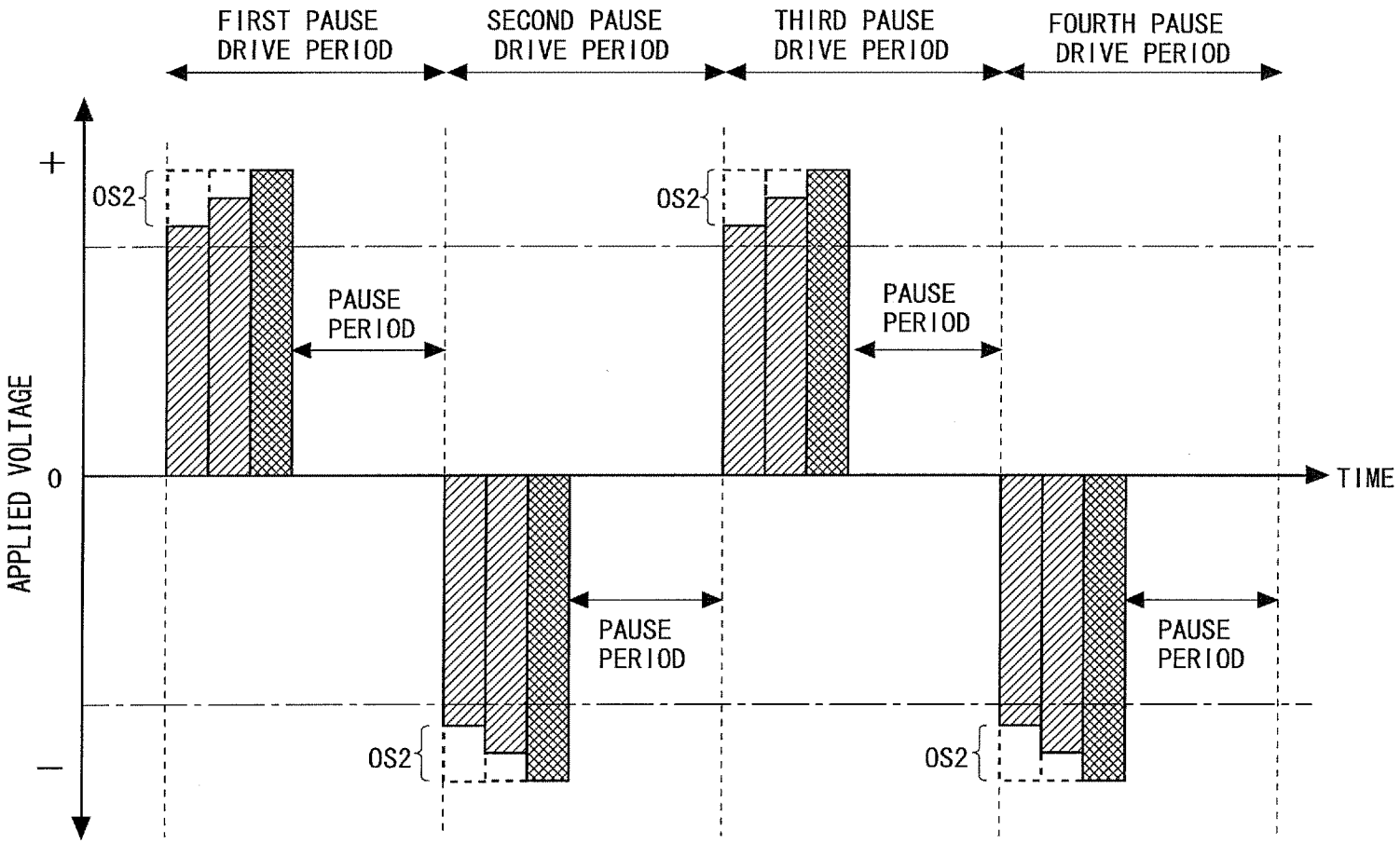
FIG. 12 is a diagram describing pause drive, incorporating undershoot drive, in the first variant of the first embodiment where voltage values increase gradually.

Furthermore, in the case of the overshoot drive shown in FIG. 9, the values for the overshoot voltages to be written at the two consecutive performances of overshoot drive are the same. However, these voltage values may be different, and for example, overshoot drive may be performed by writing overshoot voltages whose values decrease gradually, as shown in FIG. 11. Moreover, undershoot drive may be performed by writing undershoot voltages whose values increase gradually, as shown in FIG. 12.

Note that in any of the cases shown in FIGS. 9 through 12, it is necessary to display an image corresponding to an input image signal during the pause period, and therefore, normal drive in which signal voltages whose values correspond to the input image signal are written needs to be performed in the last drive frame of the drive period.

<1.6 Second Variant>

In the above embodiment, the TFT of the pixel forming portion 15 is the IGZO-TFT 16. However, it may be a TFT whose channel layer is made of amorphous silicon (Si) or polysilicon. In the following, the TFT whose channel layer is made of amorphous silicon will be referred to as an "a-TFT", and the TFT whose channel layer is made of polysilicon will be referred to as a "p-TFT". When compared to the IGZO-TFT, the a-TFT and the p-TFT offer very high off-leakage current. Therefore, the signal voltage written in the pixel forming portion 15 drops in a short period of time.

Therefore, a second variant of the present embodiment will be described with respect to a liquid crystal display device using the a-TFTs or the p-TFTs as the switching elements of the pixel forming portions 15. The configuration of such a liquid crystal display device is the same as that of the liquid crystal display device 100 shown in FIG. 1, except that the a-TFTs or the p-TFTs are used in place of InGaZnO, and therefore, any description and block diagram thereof will be omitted.

Figure 13:
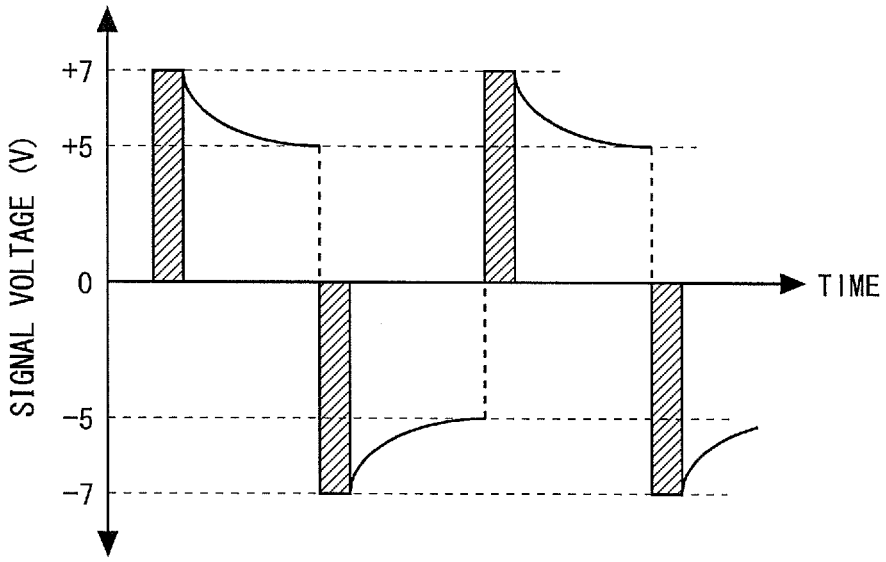
FIG. 13 is a diagram showing temporal changes in a signal voltage written in liquid crystal capacitance where a-TFTs are used as switching elements of pixel forming portions included in a liquid crystal display device according to a second variant of the first embodiment.

FIG. 13 is a diagram showing temporal changes in the signal voltage written in liquid crystal capacitance where the a-TFTs are used as the switching elements of the pixel forming portions 15 included in the liquid crystal display device in the present variant. As shown in FIG. 13, a signal voltage of the positive polarity (e.g., +7V) is written, and the a-TFT is turned off to maintain the written voltage for a predetermined period of time. Next, a signal voltage of the negative polarity (e.g., −7V) is written, and the a-TFT is turned off to maintain the written voltage for a predetermined period of time. These operations will be repeated. Since the a-TFT offers high off-leakage current, the value for the signal voltage drops to +5V during the pause period when the signal voltage of +7V is written as above or rises to −5V during the pause period when the signal voltage of −7V is written as above.

Figure 14:
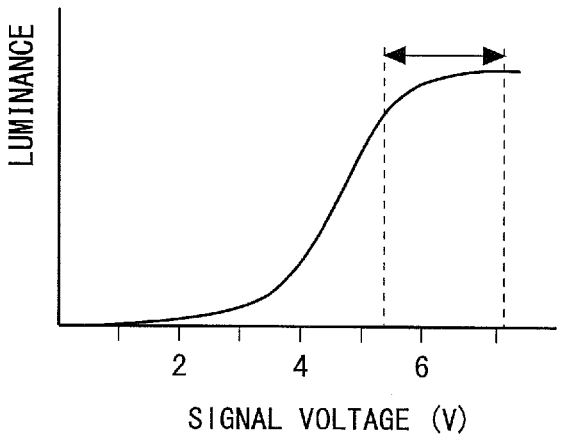
FIG. 14 is a diagram showing the relationship between signal voltage and luminance where the a-TFTs are used as the switching elements of the pixel forming portions included in the liquid crystal display device according to the second variant of the first embodiment.

However, in the liquid crystal display device using the a-TFTs, the luminance is low when the signal voltage is low, but the luminance increases sharply as the signal voltage rises, as shown in FIG. 14. In addition, the luminance is approximately constant when the signal voltage is about 5 to 7V. According to these results, the liquid crystal display device using the a-TFTs is not suitable for displaying a multitone image as liquid crystal display devices using IGZO-TFTs do, but it is capable of displaying an image, such as a black-and-white image, which can be displayed with two luminance values. Furthermore, by attaching RGB color filters to the surface of the liquid crystal panel, it is rendered possible to display an image represented by nine colors, including black.

Figure 15:
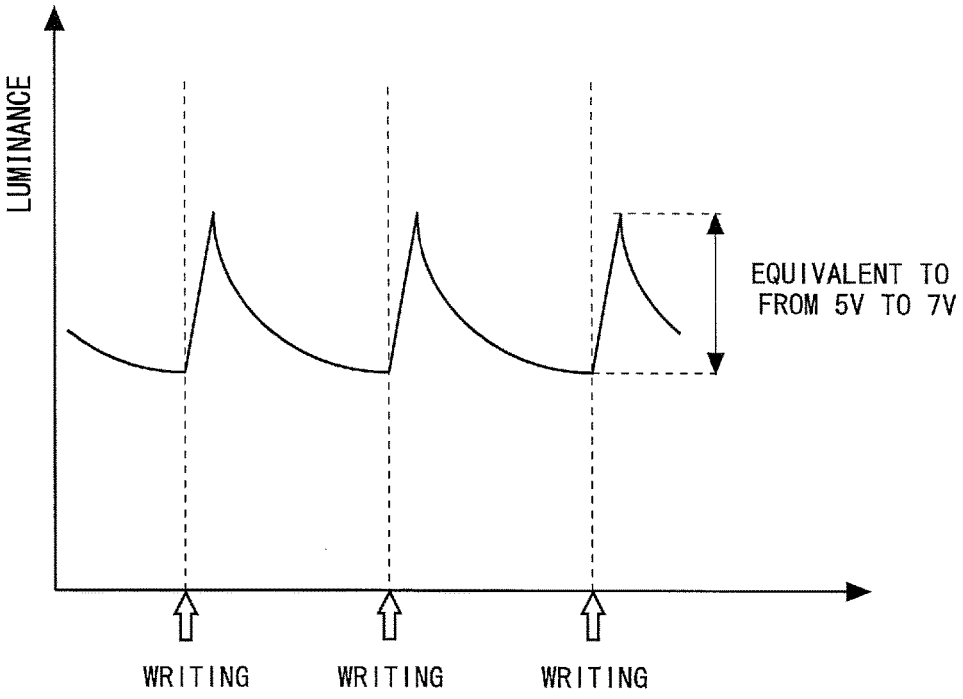
FIG. 15 is a diagram schematically illustrating luminance changes where the a-TFTs are used as the switching elements of the pixel forming portions according to the second variant of the first embodiment.

FIG. 15 is a diagram schematically illustrating luminance changes where the a-TFTs are used as the switching elements of the pixel forming portions in the present variant. Unlike in FIG. 35 where the IGZO-TFTs are used, the luminance increases when the signal voltage is written at the beginning of each pause drive period. However, thereafter, the written signal voltage drops because of the off-leakage current of the a-TFT, so that the luminance drops as well. By adjusting the pause period such that the next writing is performed when the signal voltage drops approximately 5V, the luminance is caused to increase again when the signal voltage is written during the next pause drive period. In this case, by keeping the change in the signal voltage within the range from 5V to 7V, it is rendered possible to control the luminance during each pause drive period within such a range that the luminance can be considered approximately constant. As a result, a liquid crystal display device which can be produced at low cost is allowed to display an image, such as a black-and-white image, which can be displayed with two luminance values. Note that the a-TFT or P-TFT encompasses any TFT whose channel layer is made of a semiconductor such as amorphous silicon-germanium (SiGe) or polysilicon-germanium.

2. Second Embodiment

<2.1 Configuration of the Liquid Crystal Display Device>

Figure 16:
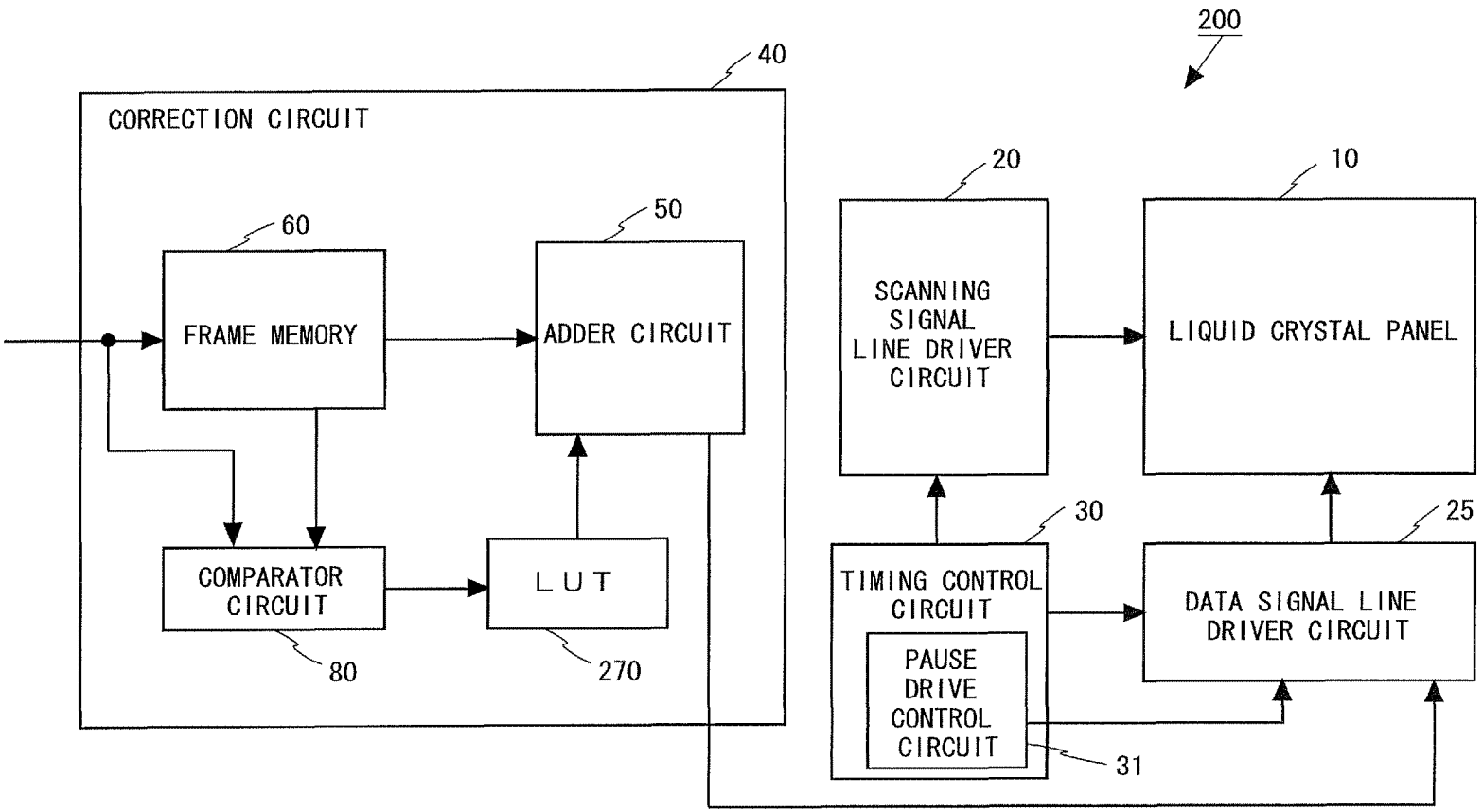
FIG. 16 is a block diagram illustrating the configuration of a liquid crystal display device according to a second embodiment of the present invention.

FIG. 16 is a block diagram illustrating the configuration of a liquid crystal display device 200 according to a second embodiment of the present invention capable of pause drive. As with the liquid crystal display device 100 shown in FIG. 1, the liquid crystal display device 200 shown in FIG. 16 includes a liquid crystal panel 10, a scanning signal line driver circuit 20, a data signal line driver circuit 25, a timing control circuit 30, and a correction circuit 40. Among these components, the correction circuit 40 differs in configuration from that shown in FIG. 1. Accordingly, in FIG. 16, the same components as those shown in FIG. 1 are denoted by the same reference characters as those assigned to the components shown in FIG. 1, therefore, any descriptions thereof will be omitted, and different components will be described mainly. As shown in FIG. 16, the liquid crystal display device 200 uses an LUT 270 to be described later, in place of the LUT 70 shown in FIG. 1.

FIG. 17 is a diagram showing an example of the configuration of the LUT 270 used in the liquid crystal display device 200. As shown in FIG. 17, the LUT 270 has stored therein correction values for emphasizing temporal changes in the input image signal, such that the correction values are only correlated with combinations of equal grayscale values for the previous and current frames. For example, as for the grayscale value "32" for the previous frame, only the correction value that corresponds to the grayscale value "32" for the current frame is stored, and there are no correction values stored corresponding to other grayscale values. Moreover, correction values for low grayscale values for the previous and current frames are positive, but some correction values for high grayscale values are negative. To describe it more specifically, they are negative only for the grayscale values "224" and "255" for the previous and current frames and positive for other grayscale values.

Accordingly, only when the comparator circuit 80 determines that the grayscale values for the previous and current frames are equal, the comparator circuit 80 provides the result to the LUT 270. The LUT 270 provides the adder circuit 50 with a correction value corresponding to the grayscale values provided by the comparator circuit 80. The adder circuit 50 generates a corrected image signal by adding the correction value to the grayscale value for the current frame when the correction value is positive or by subtracting the correction value from the grayscale value for the current frame when the correction value is negative, and outputs the generated signal to the data signal line driver circuit 25.

On the other hand, when the comparator circuit 80 determines that the grayscale values for the previous and current frames are not equal, the comparator circuit 80 does not provide the result to the LUT 270. Accordingly, the adder circuit 50 outputs the grayscale value for the current frame to the data signal line driver circuit 25 as an image signal without correcting the grayscale value for the current frame.

Note that in the present embodiment, the wording that the grayscale values for the previous and current frames are equal encompasses not only the case where the grayscale values for both are completely equal but also the case where the grayscale values for both are essentially equal. Herein, the grayscale values that are essentially equal include grayscale values in the range of ±8 with respect to the grayscale values listed in the LUT 270. For example, when the grayscale value for one frame is 32, the grayscale values in the range from 24 to 40 for the other frame are considered essentially equal to the grayscale value "32" for the former frame. Accordingly, in the case where the grayscale value for the previous frame is 28, and the grayscale value for the current frame is 36, both are considered essentially equal, and the adder circuit 50 adds 5, which is the correction value in the LUT 270 that corresponds to the grayscale value "32" for both the previous and current frames, to the grayscale value for the current frame.

<2.2 Operation During Pause Drive>

Figure 18:
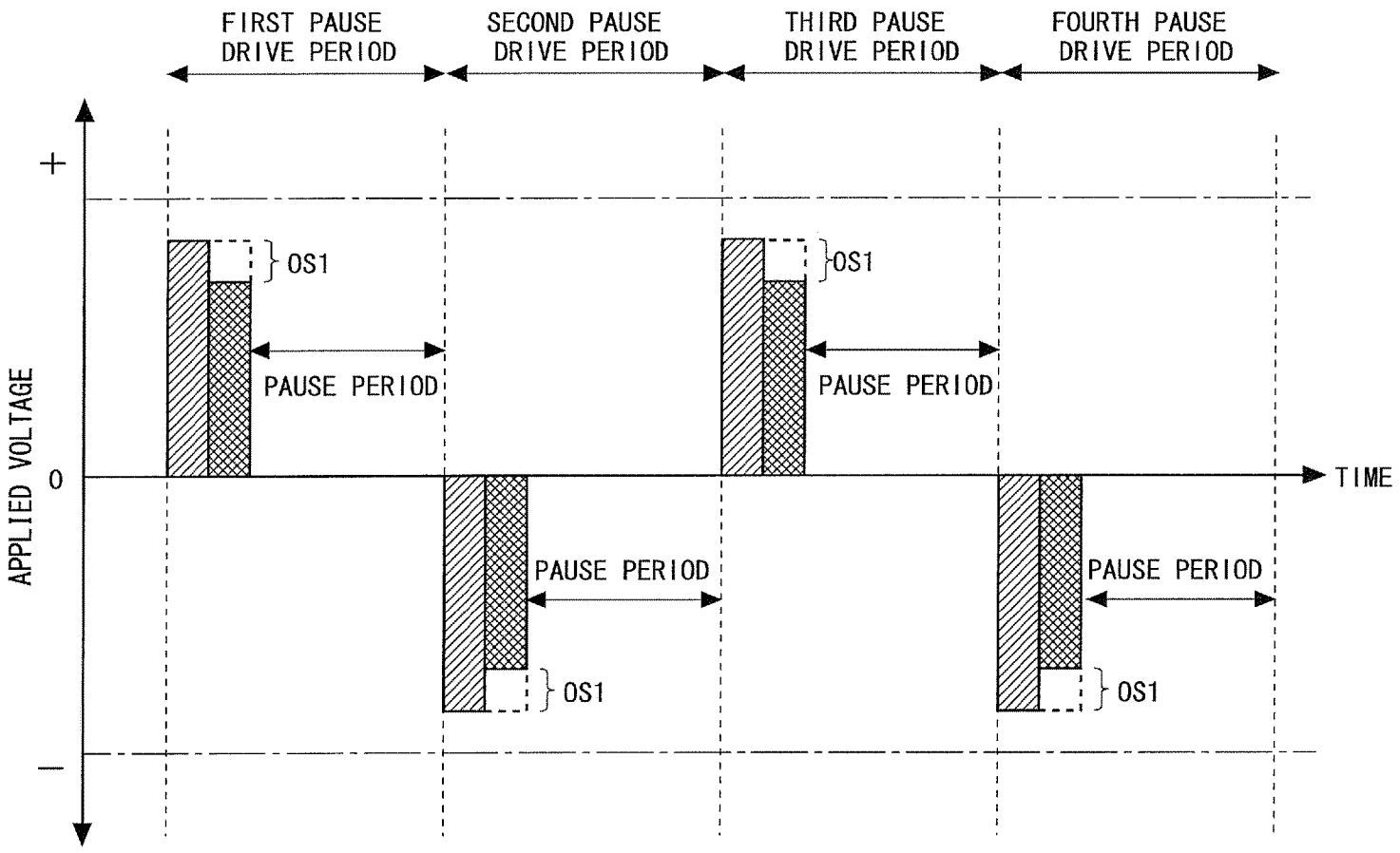
FIG. 18 is a diagram describing pause drive, incorporating overshoot drive, in the liquid crystal display device shown in FIG. 16 where grayscale values for previous and current frames are the same.
Figure 19:
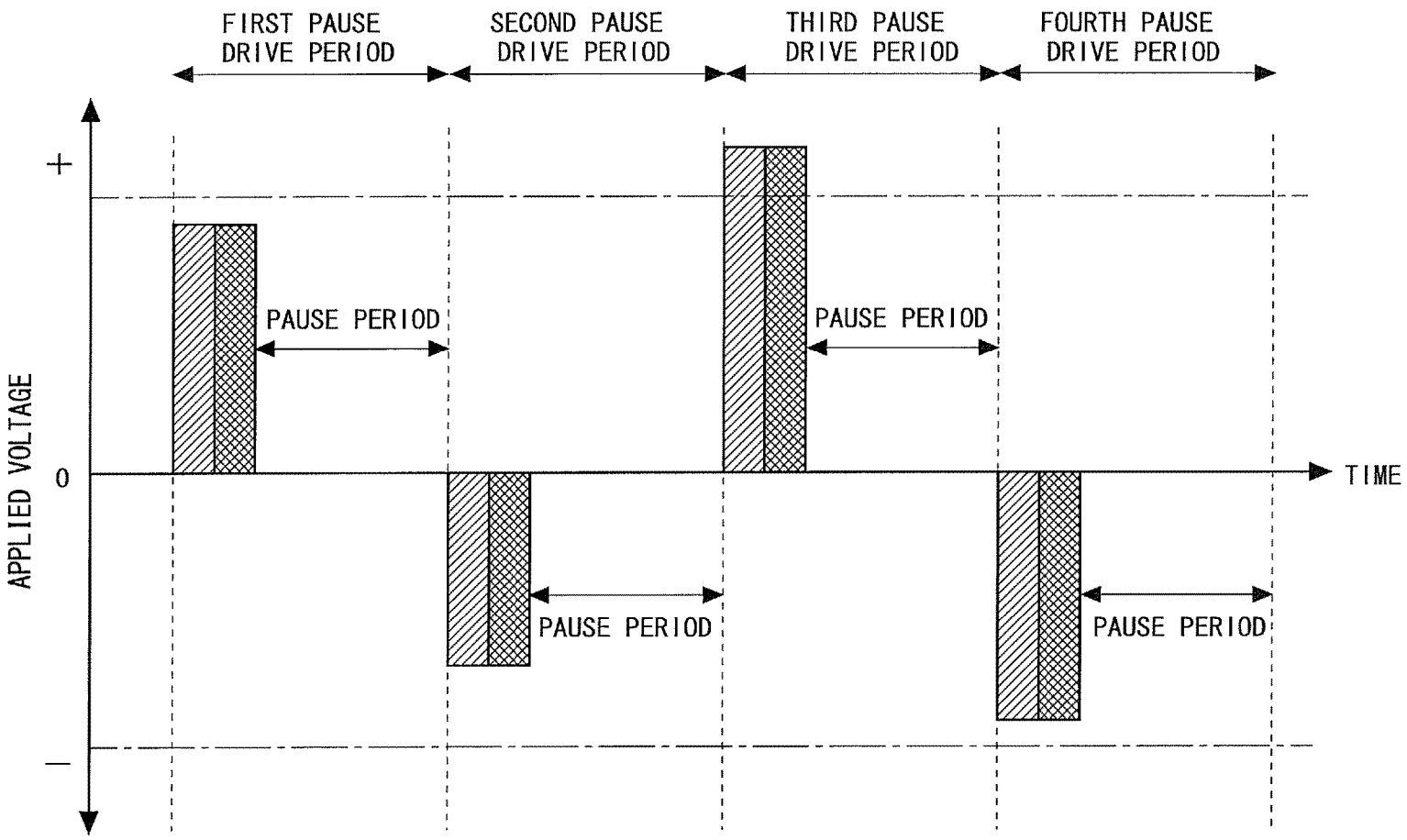
FIG. 19 is a diagram describing pause drive in the liquid crystal display device shown in FIG. 16 where the grayscale values for the previous and current frames are different.

FIG. 18 is a diagram describing pause drive, incorporating overshoot drive, where the grayscale values for the previous and current frames are the same. FIG. 19 is a diagram describing pause drive where the grayscale values for the previous and current frames are different. Note that the pause drive shown in FIG. 18 is the same as that described in conjunction with FIG. 5, and therefore, any description thereof will be omitted.

In any pause drive periods, the grayscale values for the previous and current frames are different, as shown in FIG. 19, and therefore, the circuit 50 is not provided with any correction value from the LUT 270. Accordingly, when the adder circuit 50 is provided with an input image signal from the frame memory 60, the adder circuit 50 outputs the signal without correcting the signal with a correction value. As a result, neither overshoot drive nor undershoot drive is performed.

In the second drive frame also, when the input image signal from the frame memory 60 is provided, the signal is outputted to the data signal line driver circuit 25 as an image signal without correction. The image signal is written to the data signal lines SL after conversion to signal voltages with values corresponding to the input image signal. In this manner, the voltages with the same magnitude are outputted in the first and second drive frames, and therefore, the result is the same as if normal drive were performed twice. In this manner, normal drive is performed twice to write the signal voltages to the data signal lines SL, and a pause period in which an image corresponding to the signal voltages written by normal drive is displayed continues thereafter until the start of the first drive period in the next pause drive period.

Thereafter, similarly, in each odd pause drive period, normal drive in which signal voltages of the positive polarity are written without addition of a correction value is performed twice in succession and followed by a pause period. Moreover, in each even pause drive period, normal drive is performed twice in succession by writing signal voltages of the negative polarity without addition of a correction value, and followed by a pause period.

<2.3 Effects>

Flicker is recognizable when the same image continues to be displayed. Accordingly, in the present embodiment, overshoot or undershoot drive is performed only when images with essentially the same grayscale value are displayed in succession, and thereafter, normal drive is performed. This allows the viewer to barely recognize flicker.

Moreover, in the case where images with essentially different grayscale values are displayed in succession, even if flicker occurs because of a decrease in luminance, the viewer barely recognizes such flicker. Therefore, normal drive is performed twice without overshoot or undershoot drive being performed. This allows a reduction in the memory capacity of the LUT 270, resulting in reduced cost of the liquid crystal display device 200.

Note that in the case where the response speed of the liquid crystal is fast, if the grayscale values for the previous and current frames are different, neither the first and second drive frames nor the third and fourth drive frames are set in succession, and only the first drive frame is set so as to be followed by a pause period, rather than by the second drive frame, or only the third drive frame may be set so as to be followed by a pause period, rather than by the fourth drive frame. In such a case, setting neither the second drive frame nor the fourth drive frame reduces power consumption by the liquid crystal display device.

<2.4 First Variant>

Figure 20:
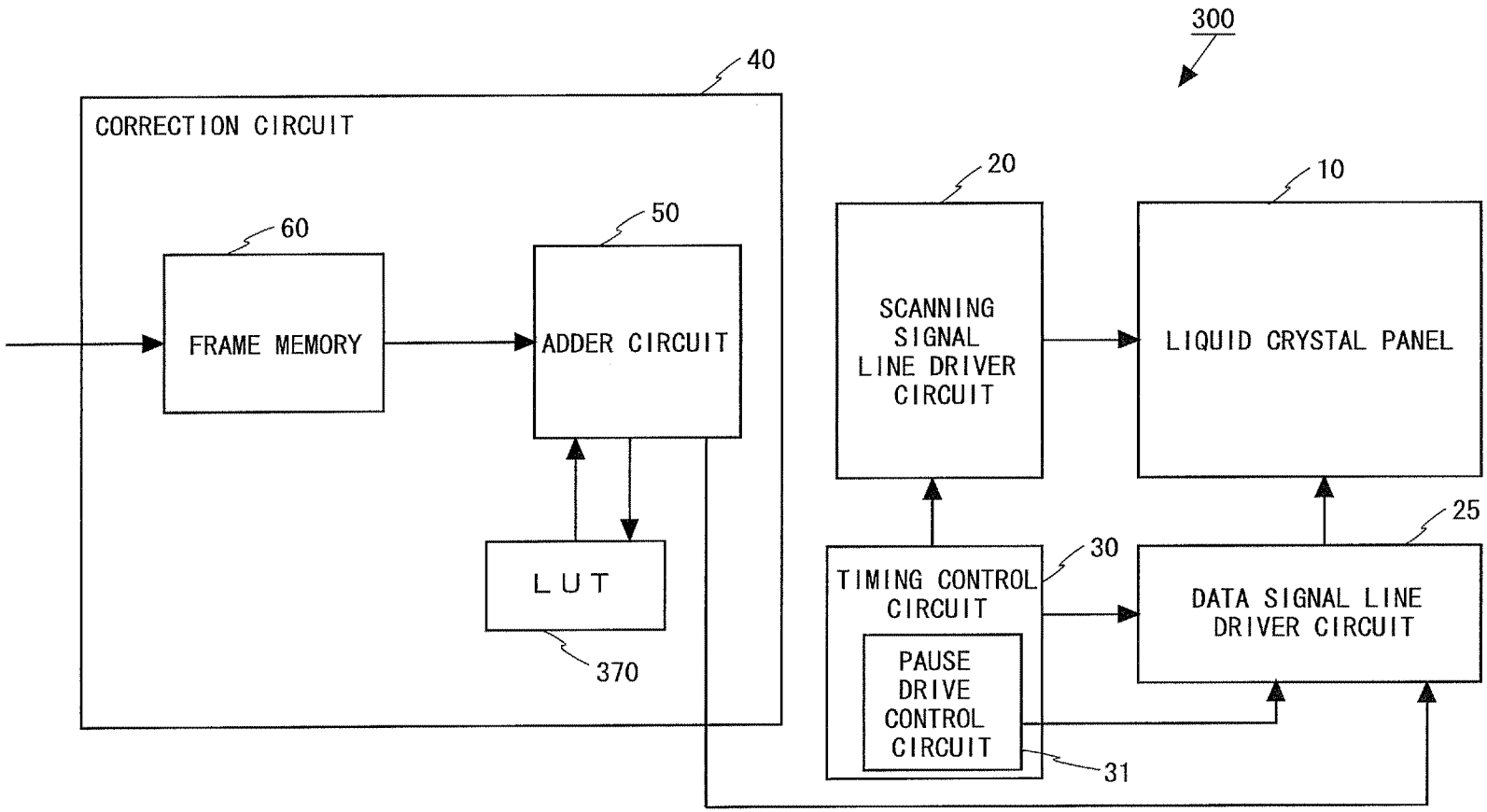
FIG. 20 is a block diagram of a liquid crystal display device according to a first variant of the liquid crystal display device shown in FIG. 16.

FIG. 20 is a block diagram of a liquid crystal display device 300 according to a first variant of the present embodiment. As with the liquid crystal display device 100 shown in FIG. 1, the liquid crystal display device 300 shown in FIG. 20 includes a liquid crystal panel 10, a scanning signal line driver circuit 20, a data signal line driver circuit 25, a timing control circuit 30, and a correction circuit 40. Among these components, the correction circuit 40 differs in configuration from that shown in FIG. 1. Accordingly, in FIG. 20, the same components as those shown in FIG. 1 are denoted by the same reference characters as those assigned to the components shown in FIG. 1, therefore, any descriptions thereof will be omitted, and different components will be described mainly.

As shown in FIG. 20, the correction circuit 40 includes frame memory 60, an adder circuit 50, and an LUT 370, but does not include any comparator circuit. The reason why no comparator circuit is provided in the present variant is that there is no need to determine whether the grayscale values for the previous and current frames are equal. FIG. 21 is a diagram showing an example of the configuration of the LUT 370 used in the present variant. Unlike the LUT 70 shown in FIG. 2, the LUT 370 has only stored therein correction values corresponding to grayscale values for the current frame. In this manner, the correction value is determined only by the grayscale value for the current frame, regardless of the grayscale value for the previous frame. In the LUT 370, the correction values for any grayscale values of 160 or lower for the current frame are positive, the correction value for the grayscale value "192" for the current frame is zero, and the correction values for any grayscale values of 224 or higher for the current frame are negative.

Accordingly, unlike in the second embodiment, in the case where a correction value corresponding to the grayscale value for the current frame is positive, the adder circuit 50 generates a corrected image signal by adding the correction value to the grayscale value for the current frame, regardless of the grayscale value for the previous frame, and outputs the generated signal to the data signal line driver circuit 25. As a result, overshoot drive is performed. Moreover, in the case where the correction value corresponding to the grayscale value for the current frame is negative, a corrected image signal is generated with subtraction of the correction value, and outputted to the data signal line driver circuit 25. As a result, undershoot drive is performed. Note that in the case where the correction value is zero, the input image signal is outputted to the data signal line driver circuit 25 without correction.

<2.4.1 Operation During Pause Drive>

Figure 22:
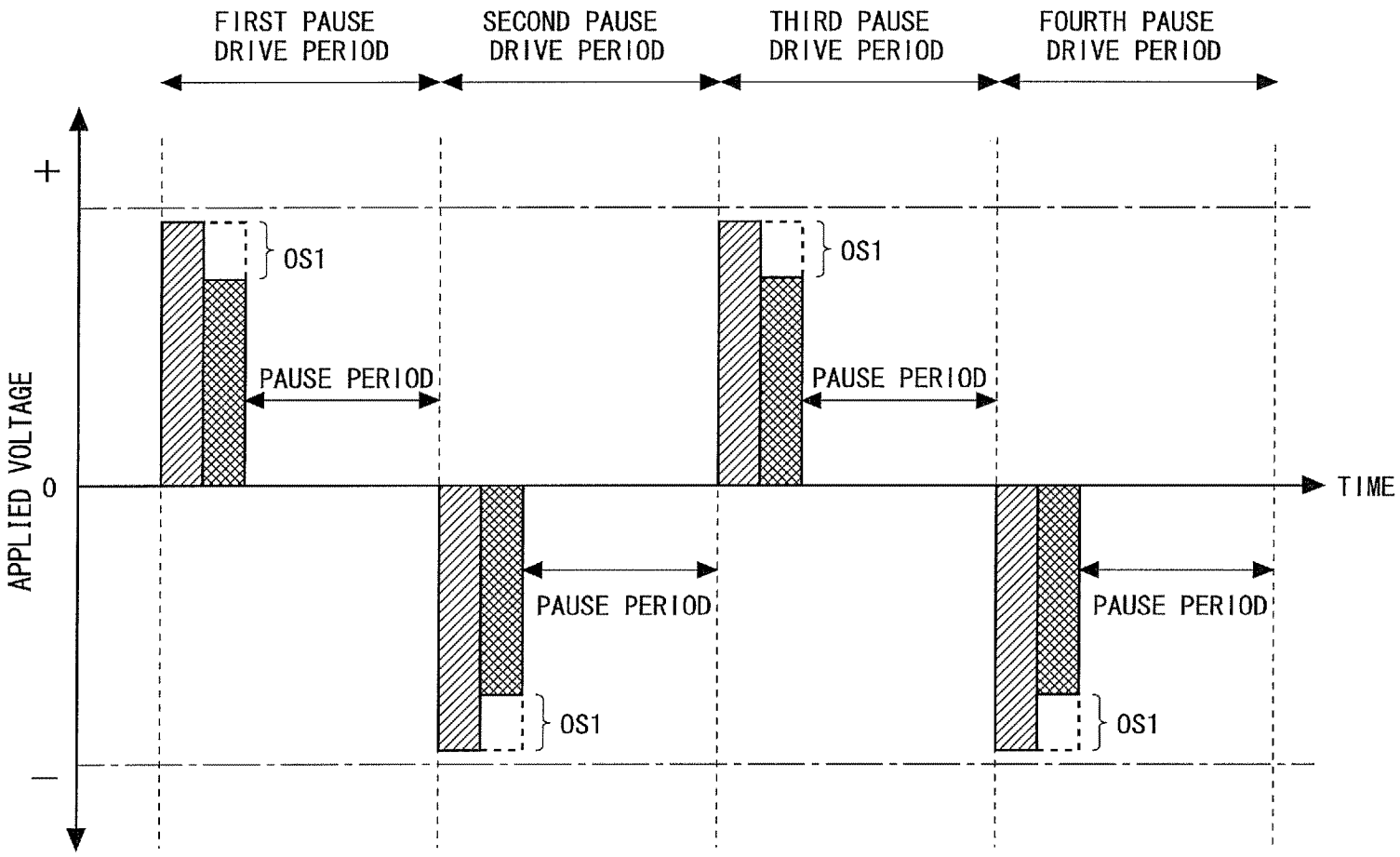
FIG. 22 is a diagram describing pause drive, incorporating overshoot drive, in the liquid crystal display device shown in FIG. 20 where grayscale values for previous and current frames are the same.
Figure 23:
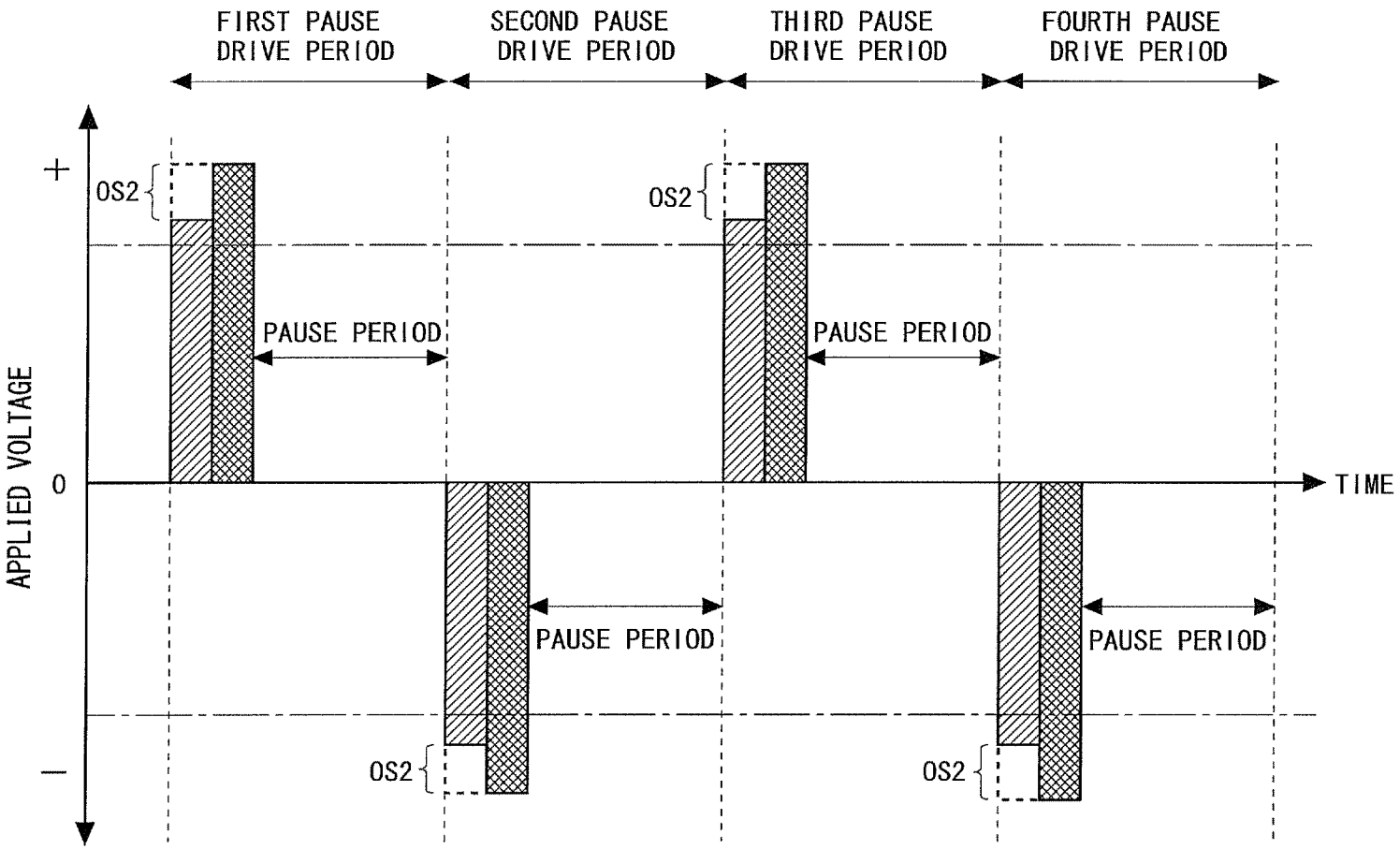
FIG. 23 is a diagram describing pause drive, incorporating undershoot drive, in the liquid crystal display device shown in FIG. 20 where the grayscale values for the previous and current frames are the same.
Figure 24:
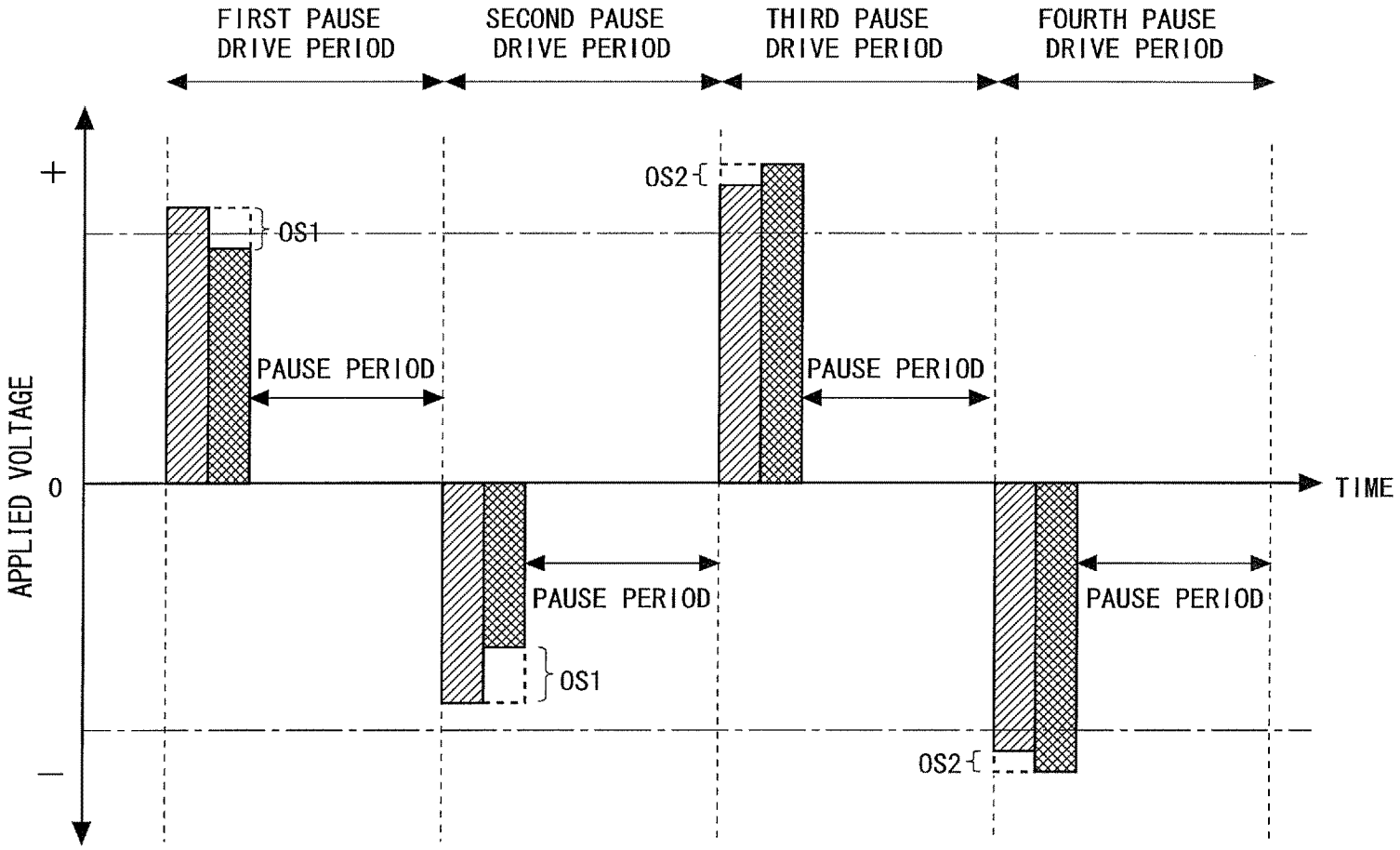
FIG. 24 is a diagram describing pause drive in the liquid crystal display device shown in FIG. 20 where the grayscale values for the previous and current frames are different.

FIG. 22 is a diagram describing pause drive, incorporating overshoot drive, where the grayscale values for the previous and current frames are the same, and FIG. 23 is a diagram describing pause drive, incorporating undershoot drive, where the grayscale values for the previous and current frames are the same. FIG. 24 is a diagram describing pause drive where the grayscale values for the previous and current frames are different.

In the case shown in FIG. 22, first and second drive frames are set consecutively within a drive period of a first pause drive period. In the first drive frame, when the adder circuit 50 is provided with a correction value from the LUT 370 which corresponds to a grayscale value for the current frame provided by the frame memory 60, the adder circuit 50 generates a corrected image signal by adding the correction value to the grayscale value for the current frame because the grayscale value for an input image signal (i.e., the grayscale value for the current frame) is lower than the boundary value, and the adder circuit 50 outputs the generated signal to the data signal line driver circuit 25. The corrected image signal is written to the data signal lines SL after conversion to overshoot voltages higher by the correction value "OS1" than the voltage value that corresponds to the input image signal. The polarity of the analog signal voltages is positive. As a result, overshoot drive is performed.

In the second drive frame, the frame memory 60 has stored therein the same input image signal as that used in the first drive frame. When the adder circuit 50 is provided with the input image signal from the frame memory 60, the adder circuit 50 outputs the signal to the data signal line driver circuit 25 as an image signal without addition of a correction value. The image signal is written to the data signal lines SL after conversion to signal voltages corresponding to the input image signal. The polarity of the analog signal voltages is also positive. As a result, normal drive is performed.

In this manner, in the first drive frame, overshoot drive is performed using the correction value provided by the LUT 370, and in the second drive frame, normal drive is performed so that signal voltages of the positive polarity are written to the data signal lines SL. Thereafter, a pause period in which an image corresponding to the signal voltages written by normal drive is displayed continues until the start of the first drive period in the second pause drive period.

In the drive period of the second pause drive period also, first and second drive frames are set consecutively. In this case, as in the first pause drive period, overshoot drive is performed in the first drive frame in accordance with a corrected image signal obtained by adding a correction value provided by the LUT 370 to the grayscale value for the current frame, and normal drive is performed in the second drive frame. In any of the drive frames, voltages of the negative polarity are written. Thereafter, a pause period in which an image corresponding to the signal voltages written by normal drive is displayed continues until the start of the first drive period in the third pause drive period.

Thereafter, similarly, in each odd pause drive period, overshoot drive is performed by writing overshoot voltages of the positive polarity. Then, normal drive is performed by writing signal voltages of the positive polarity, and followed by a pause period. Moreover, in each even pause drive period, overshoot drive is performed by writing overshoot voltages of the negative polarity. Then, normal drive is performed by writing signal voltages of the negative polarity, and followed by a pause period.

In the case shown in FIG. 23, third and fourth drive frames are set consecutively within a drive period of a first pause drive period. In the third drive frame, when the adder circuit 50 is provided with a correction value from the LUT 370 which corresponds to a grayscale value for the current frame provided by the frame memory 60, the adder circuit 50 generates a corrected image signal by subtracting the correction value from the grayscale value for the current frame because the grayscale value for an input image signal (i.e., the grayscale value for the current frame) is higher than the boundary value, and the adder circuit 50 outputs the generated signal to the data signal line driver circuit 25. The corrected image signal is written to the data signal lines SL after conversion to undershoot voltages lower by the correction value "OS2" than the voltage value that corresponds to the input image signal. The polarity of the analog signal voltages is positive. As a result, undershoot drive is performed.

In the fourth drive frame, the frame memory 60 has stored therein the same input image signal as that used in the third drive frame. When the adder circuit 50 is provided with the input image signal from the frame memory 60, the adder circuit 50 outputs the signal to the data signal line driver circuit 25 as an image signal without subtraction of a correction value. The image signal is written to the data signal lines SL after conversion to signal voltages corresponding to the input image signal. The polarity of the analog signal voltages is also positive. As a result, normal drive is performed.

In this manner, in the third drive frame, undershoot drive is performed using the correction value provided by the LUT 370, and in the fourth drive frame, normal drive is performed so that signal voltages of the positive polarity are written to the data signal lines SL. Thereafter, a pause period in which an image corresponding to the signal voltages written by normal drive is displayed continues until the start of the first drive period in the second pause drive period.

In the drive period of the second pause drive period also, third and fourth drive frames are set consecutively. In the third drive frame, the absolute value of the grayscale value for the current frame is greater than or equal to the boundary value. Accordingly, undershoot drive is performed in accordance with a corrected image signal obtained by subtracting a correction value provided by the LUT 370 from the grayscale value for the current frame, and normal drive is performed in the fourth drive frame. In any of the drive frames, voltages of the negative polarity are written. Thereafter, a pause period in which an image corresponding to the signal voltages written by normal drive is displayed continues until the start of the first drive period in the third pause drive period.

Thereafter, similarly, in each odd pause drive period, undershoot drive is performed by writing undershoot voltages of the positive polarity. Then, normal drive is performed by writing signal voltages of the positive polarity, and followed by a pause period. Moreover, in each even pause drive period, undershoot drive is performed by writing undershoot voltages of the negative polarity. Then, normal drive is performed by writing signal voltages of the negative polarity, and followed by a pause period.

In the case shown in FIG. 24, the LUT 370 is used, and therefore, whether to perform overshoot drive or undershoot drive is determined by the grayscale value for the current frame. Specifically, in each pause drive period, overshoot drive is performed when the grayscale value for the current frame is lower than the boundary value, whereas undershoot drive is performed when the grayscale value for the current frame is higher than the boundary value. More specifically, overshoot drive is performed during the first and second pause drive periods, and undershoot drive is performed during the third and fourth pause drive periods.

In this manner, in the present variant, regardless of whether the grayscale values for the previous and current frames are equal, overshoot or undershoot drive is performed only in accordance with the grayscale value for the current frame. Accordingly, in the present variant, unlike in the second embodiment, it is necessary to always perform normal drive in the second and fourth drive frames, and the second drive frame and the fourth drive frame drive cannot be omitted.

<2.4.2 Effects>

The present variant achieves the same effects as those achieved by the second embodiment, and further, eliminates the need to provide any comparator circuit because there is no need to determine whether the grayscale values for the previous and current frames are the same. Thus, the production cost for the liquid crystal display device 300 can be further reduced.

<2.5 Second Variant>

In the first variant, there is no difference in the amount of correction stored in the LUT 370 between the case where the polarity of the input image signal changes from positive to negative and the case where the polarity changes from negative to positive.

However, in the case where the dielectric anisotropy of the liquid crystal varies among directions of voltages applied to the liquid crystal layer, so that liquid crystal molecules tend to be oriented in one direction and do not tend to be oriented in the other direction, the response speed of the liquid crystal might vary among directions of applied voltages. In such a case, even if the grayscale values for the previous and current frames are the same, it is necessary to change the overshoot and undershoot voltages in accordance with the direction of the applied voltage. Accordingly, the correction circuit of the liquid crystal display device is provided with an LUT (also referred to as a "first table") having correction values stored for one direction in which the voltage is applied, as well as an LUT (also referred to as a "second table") having correction values stored for the opposite direction. Note that configuration examples of the LUTs are omitted in the present variant.

Figure 25:
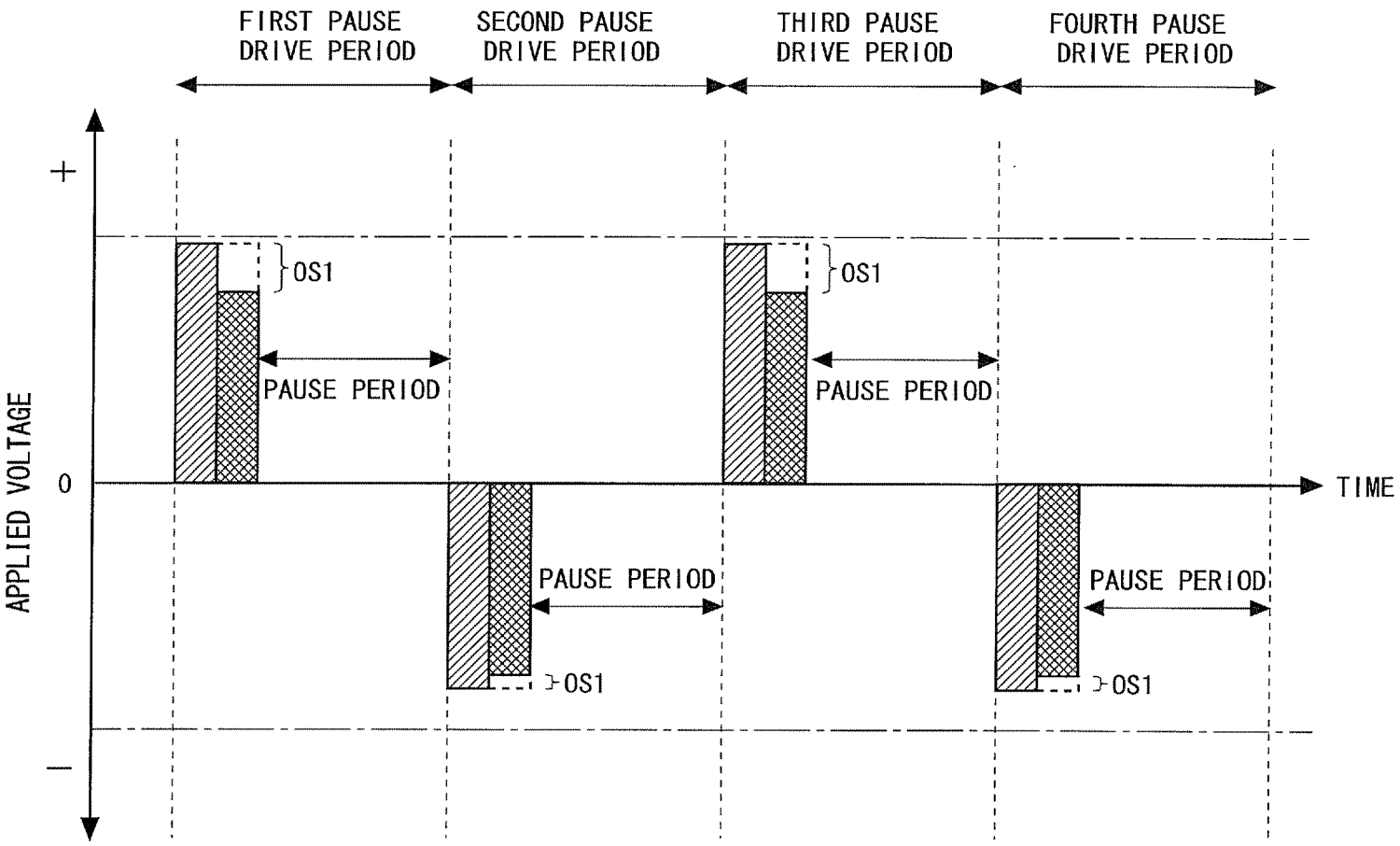
FIG. 25 is a diagram describing pause drive, incorporating overshoot drive, in a second variant of the liquid crystal display device shown in FIG. 16 where grayscale values for previous and current frames are the same.
Figure 26:
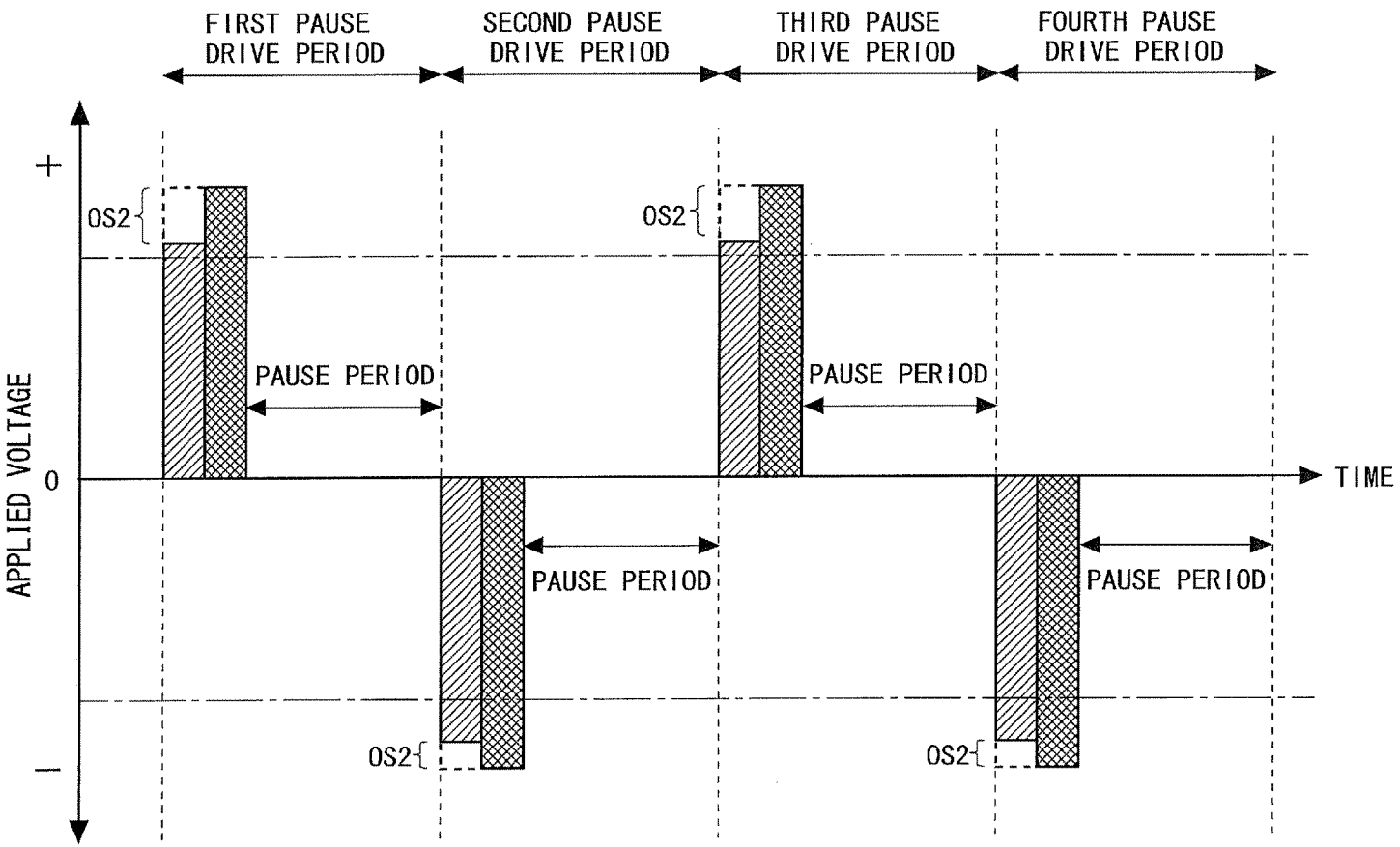
FIG. 26 is a diagram describing pause drive, incorporating undershoot drive, in the second variant of the liquid crystal display device shown in FIG. 16 where the grayscale values for the previous and current frames are the same.

FIG. 25 is a diagram describing pause drive, incorporating overshoot drive, where the grayscale values for the previous and current frames are the same, and FIG. 26 is a diagram describing pause drive, incorporating undershoot drive, where the grayscale values for the previous and current frames are the same. As shown in FIG. 25, even when the grayscale values for the previous and current frames are equal, the overshoot voltages vary between the case where the polarity of the input image signal changes from positive to negative and the case where the polarity changes from negative to positive, and the absolute value of the overshoot voltage value is higher in the case where the polarity changes from negative to positive than in the opposite case. Even if the grayscale values for the previous and current frames are the same, such overshoot drive is performed by setting correction values such that the absolute values of the correction values in the LUT used in the case where the polarity changes from negative to positive are higher than the absolute values of the correction values in the LUT used in the case where the polarity changes from positive to negative.

Furthermore, as shown in FIG. 26, even when the grayscale values for the previous and current frames are equal, the undershoot voltages vary between the case where the polarity of the input image signal changes from positive to negative and the case where the polarity changes from negative to positive, and the absolute value of the undershoot voltage value is higher in the case where the polarity changes from negative to positive than in the opposite case. Such undershoot drive is performed by setting correction values such that the absolute values of the correction values in the LUT used in the case where the polarity changes from negative to positive are higher than the absolute values of the correction values in the LUT used in the case where the polarity changes from positive to negative.

In this manner, even if the response speed of the liquid crystal varies between the case where the polarity of the voltage applied to the liquid crystal layer changes from positive to negative and the case where the polarity changes from negative to positive, the luminance change, which depends on the direction of the applied voltage, can be kept down to approximately the same level by also changing the correction value in accordance with the direction of the applied voltage. Thus, the viewer barely recognizes flicker.

Note that the present variant can be applied similarly not only to the case where the grayscale values for the previous and current frames are the same but also to the case where they are different. In addition, even in the case where the voltage correction values "OS1" and "OS2" are higher in the case where the polarity changes from positive to negative than in the case where the polarity changes in the opposite direction, drive can be performed in the same manner as in the present variant.

3. Third Embodiment

When the dielectric anisotropy of the liquid crystal changes because of a change in ambient temperature around the liquid crystal display device, the response speed of the liquid crystal display device changes conspicuously. Accordingly, if overshoot or undershoot drive is performed at low temperature using an LUT having stored correction values set at room temperature, the response speed of the liquid crystal is slower at low temperature, and therefore, cannot be increased sufficiently, so that display cannot be provided with desired grayscale values. On the other hand, if overshoot or undershoot drive is performed at high temperature, overly emphasized display is provided because the response speed of the liquid crystal is faster at high temperature. Therefore, liquid crystal display devices for use in a wide range of temperatures preferably have a plurality of different LUTs for their respective temperature ranges so that optimized overshoot drive can be performed with addition of optimal correction values suitable for the temperature.

<3.1 Configuration of the Liquid Crystal Display Device>

Figure 27:
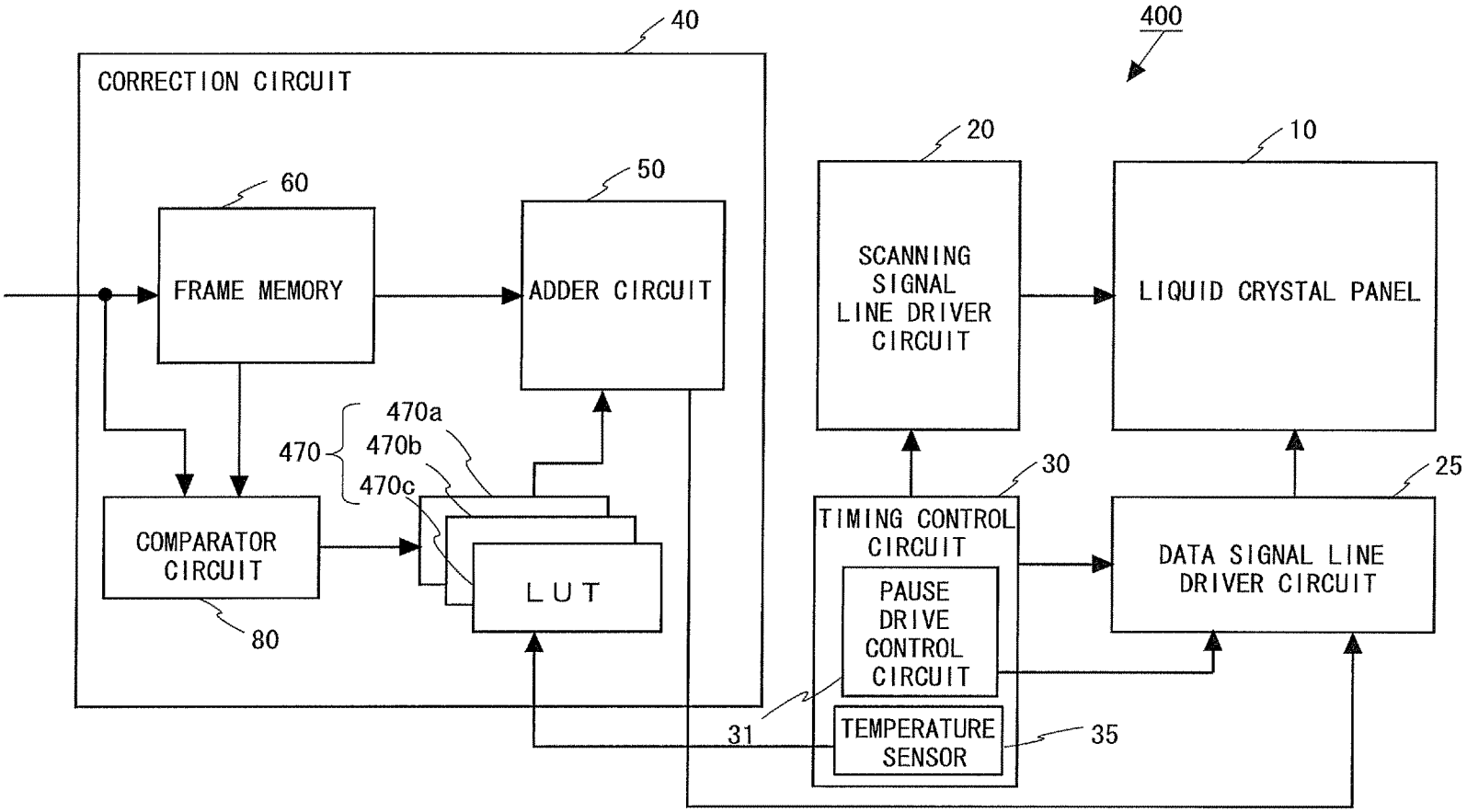
FIG. 27 is a block diagram of a liquid crystal display device according to a third embodiment of the present invention.

FIG. 27 is a block diagram of a liquid crystal display device 400 according to a third embodiment of the present invention. The liquid crystal display device 400 shown in FIG. 27 differs from the liquid crystal display device 100 shown in FIG. 1 in that a temperature sensor 35 is provided in the timing control circuit 30, and the correction circuit 40 has three LUTs 470*a* to 470*c* provided for their respective temperature ranges. Note that in FIG. 27, the same components as those shown in FIG. 1 are denoted by the same reference characters as those assigned to the components shown in FIG. 1, therefore, any descriptions thereof will be omitted, and different components will be described mainly.

FIG. 28 is a diagram showing the LUT 470*a* for room temperature for use in the liquid crystal display device 400, FIG. 29 is a diagram showing the LUT 470*b* for high temperature, and FIG. 30 is a diagram showing the LUT 470*c* for low temperature. As can be appreciated from FIGS. 28 to 30, absolute values of correction values are set so as to decrease in the order: the LUT 470*c* for low temperature, the LUT 470*a* for room temperature, and the LUT 470*b* for high temperature. Accordingly, overshoot drive and undershoot drive at low temperature at which the response speed of the liquid crystal tends to decrease are emphasized most, and followed by overshoot drive and undershoot drive at room temperature. Moreover, overshoot drive and undershoot drive at high temperature are kept less effective.

In this manner, the LUTs 470 to be used are switched in accordance with the temperature at which the liquid crystal display device 400 is used, and therefore, the temperature sensor 35 for acquiring temperature information is required. In the present embodiment, the temperature sensor 35 is provided in the timing control circuit 30, and one of the LUTs 470*a* to 470*c* is selected in accordance with temperature information from the temperature sensor 35. Upon selection of one of the LUTs 470*a* to 470*c*, overshoot or undershoot drive is performed using a correction value stored in the selected LUT, as in the above embodiments.

Note that in the present embodiment, the LUT 470*a* for room temperature is used at 10° C. or higher but less than 40° C., the LUT 470*b* for high temperature is used at 40° C. or higher, and the LUT 470*c* for low temperature is used at less than 10° C., but it is possible to appropriately adjust the temperature ranges in which they can be used. In addition, the number of LUTs 470 is not limited to three, and can be set to two or even four or more in accordance with the temperature range in which the liquid crystal display device 400 is used.

In FIG. 27, the temperature sensor 35 is provided in the timing control circuit 30, but it may be provided on the liquid crystal panel 10, rather than in the timing control circuit 30. In such a case, the timing control circuit 30 acquires temperature information from the temperature sensor 35 via serial communication, and selects one of the LUTs 470*a* to 470*c* in accordance with the temperature information. Note that in the case where the temperature sensor 35 is provided on an insulating substrate and provides temperature information to the timing control circuit 30 via serial communication, the temperature sensor 35 can be disposed in an arbitrary position on the insulating substrate. Moreover, in the case where the temperature sensor 35 is provided in the timing control circuit 30, the configuration of the timing control circuit 30 does not become complex. Accordingly, the production cost for the liquid crystal display device 400 can be reduced.

<3.2 Effects>

In the present embodiment, one of the LUTs 470*a* to 470*c* is selected in accordance with the ambient temperature around the liquid crystal display device 400 measured by the temperature sensor 35, to perform overshoot or undershoot drive, and therefore, the overshoot or undershoot drive can be optimized regardless of the temperature. As a result, also in the liquid crystal display device 400 to be used in a wide range of temperatures, the decrease in luminance at the time of writing signal voltages can be suppressed so that the viewer barely recognizes flicker.

<3.3 First Variant>

Figure 31:
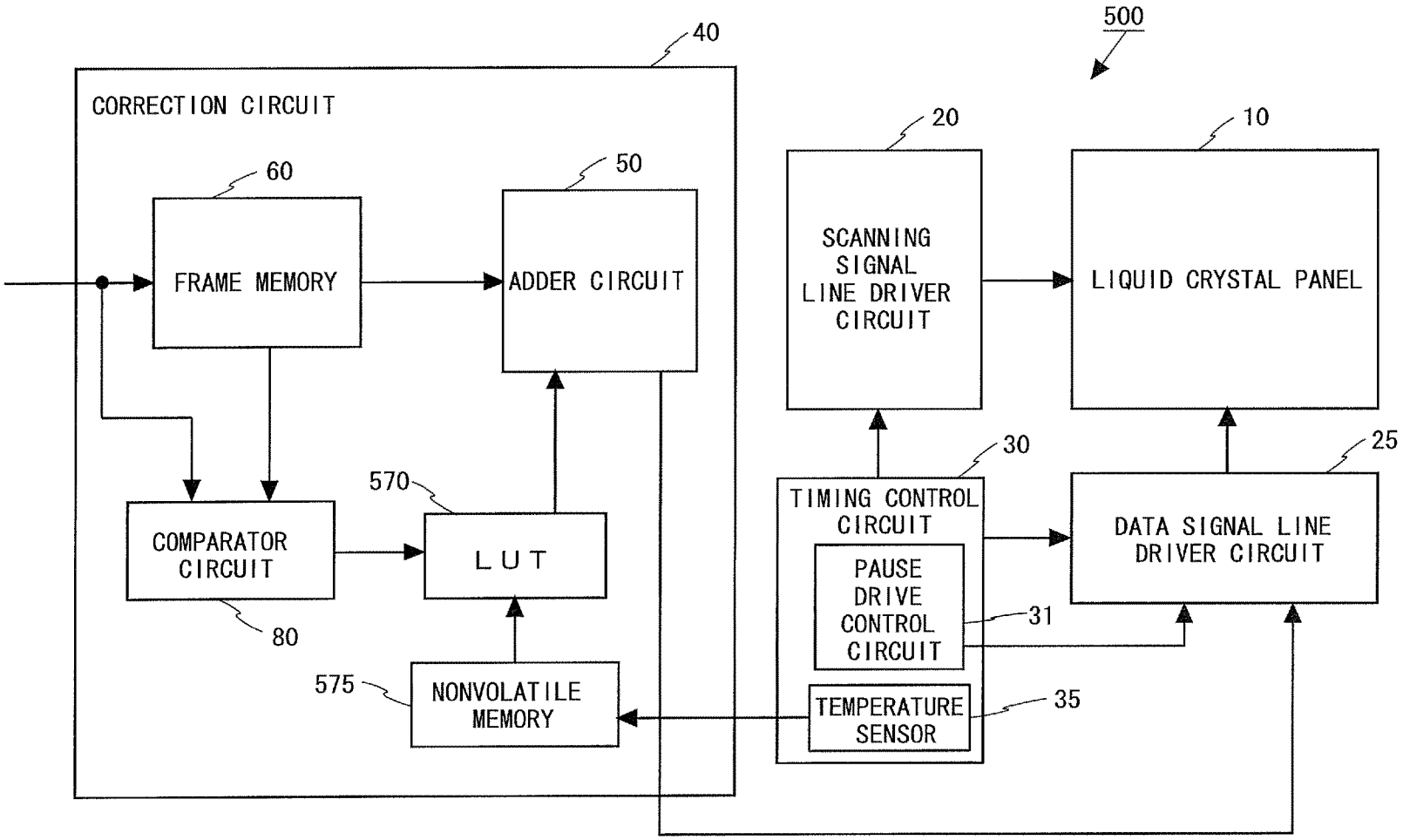
FIG. 31 is a block diagram illustrating the configuration of a liquid crystal display device according to a first variant of the third embodiment.

FIG. 31 is a block diagram illustrating the configuration of a liquid crystal display device 500 according to a first variant of the present embodiment. As shown in FIG. 31, the liquid crystal display device 500 has a similar configuration to that of the liquid crystal display device 400 shown in FIG. 27. Their differences are in that nonvolatile memory 575 is provided in the correction circuit 40, temperature information from the temperature sensor 35 is provided to the nonvolatile memory 575, and further, the number of LUTs 570 is one. Note that in FIG. 31, the same components as those shown in FIGS. 1 and 27 are denoted by the same reference characters as those assigned to the components shown in FIGS. 1 and 27, therefore, any descriptions thereof will be omitted, and different components will be described mainly.

In the liquid crystal display device 500, the nonvolatile memory 575 has prestored data for correction values for room temperature, high temperature, and low temperature. On the basis of temperature information from the temperature sensor 35, data for correction values corresponding to the temperature information is transferred from the nonvolatile memory 575 to the LUT 570. Accordingly, as in the liquid crystal display device 400 shown in FIG. 27, the LUT 570 provides the adder circuit 50 with correction values correlated with the grayscale values for the previous and current frames. The subsequent operations are the same as in the case of the liquid crystal display device 400, and therefore, any descriptions thereof will be omitted.

In this case, even when there is a need to prepare a plurality of LUTs because the liquid crystal display device 400 is used in a wide range of temperatures, only one LUT 570 is provided, and the correction values that should be stored in a plurality of LUTs are stored in the nonvolatile memory 575. In addition, data for correction values for a temperature range corresponding to temperature information provided by the temperature sensor 35 is transferred to the LUT 570. As a result, the number of LUTs can be reduced, resulting in reduced production cost for the liquid crystal display device 500.

<3.4 Second Variant>

Figure 32:
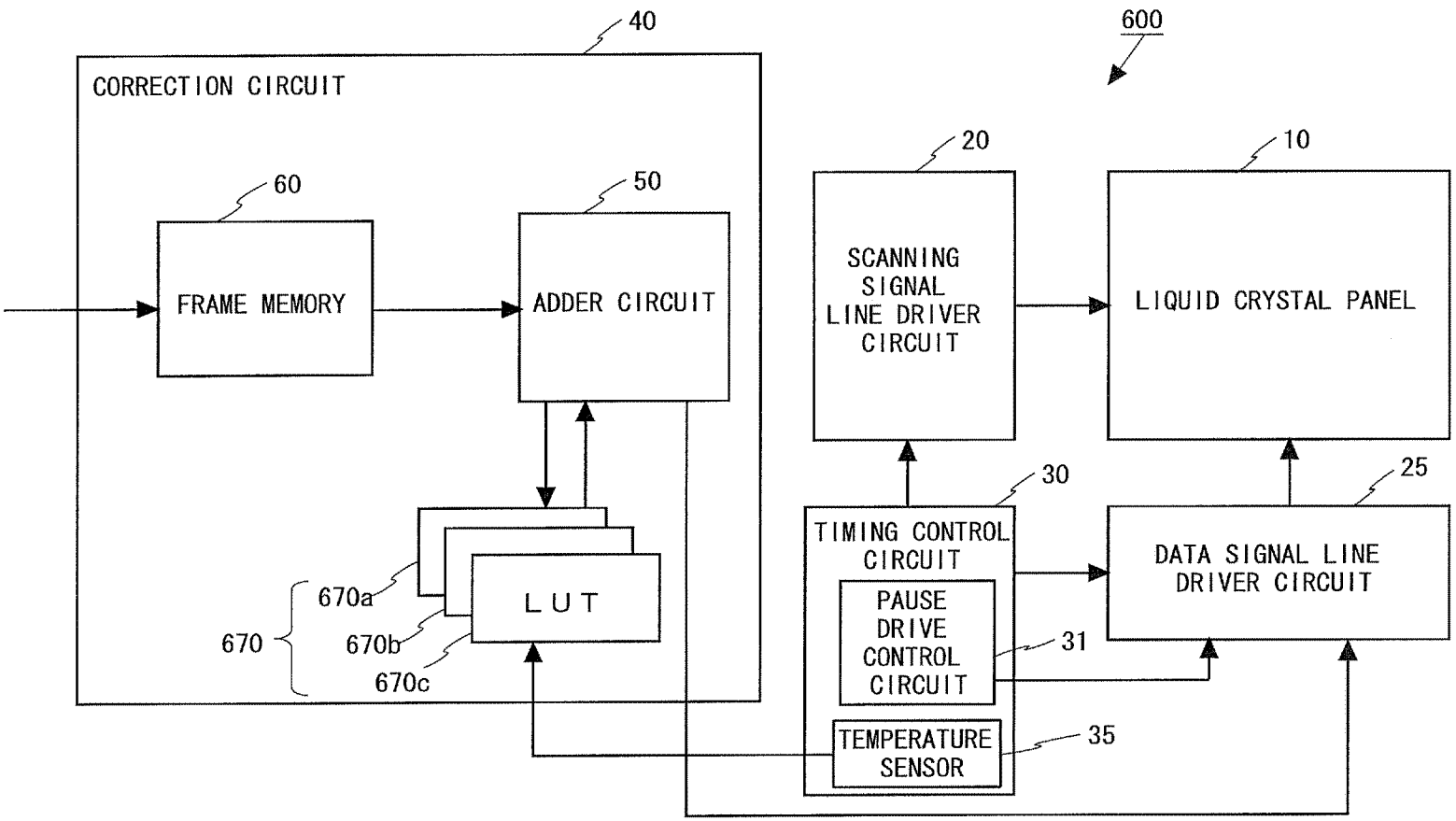
FIG. 32 is a block diagram illustrating the configuration of a liquid crystal display device equivalent to the liquid crystal display device according to the third embodiment without a comparator circuit.
Figure 33:
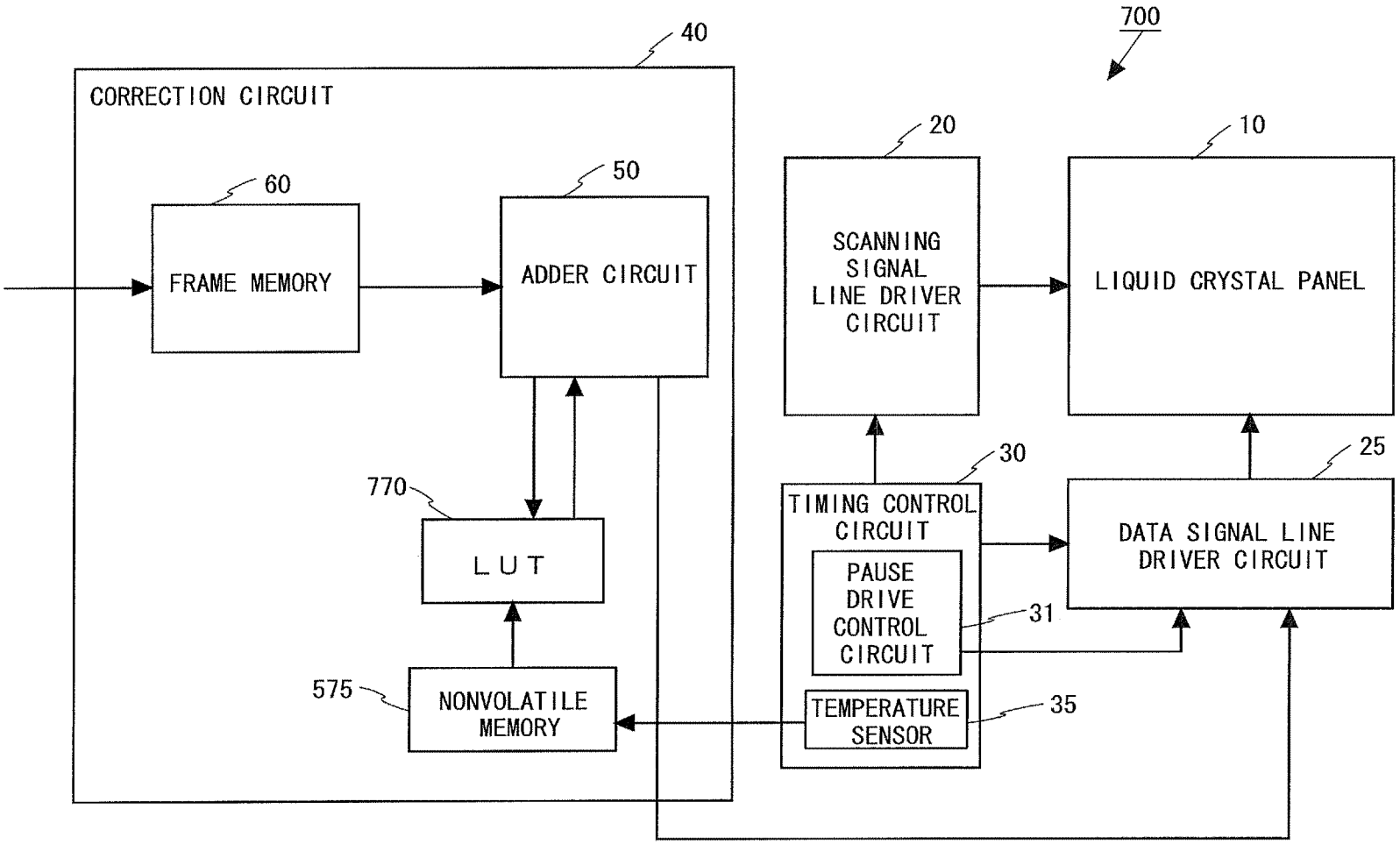
FIG. 33 is a block diagram illustrating the configuration of a liquid crystal display device equivalent to the liquid crystal display device according to the first variant of the third embodiment without a comparator circuit.
Figure 34:
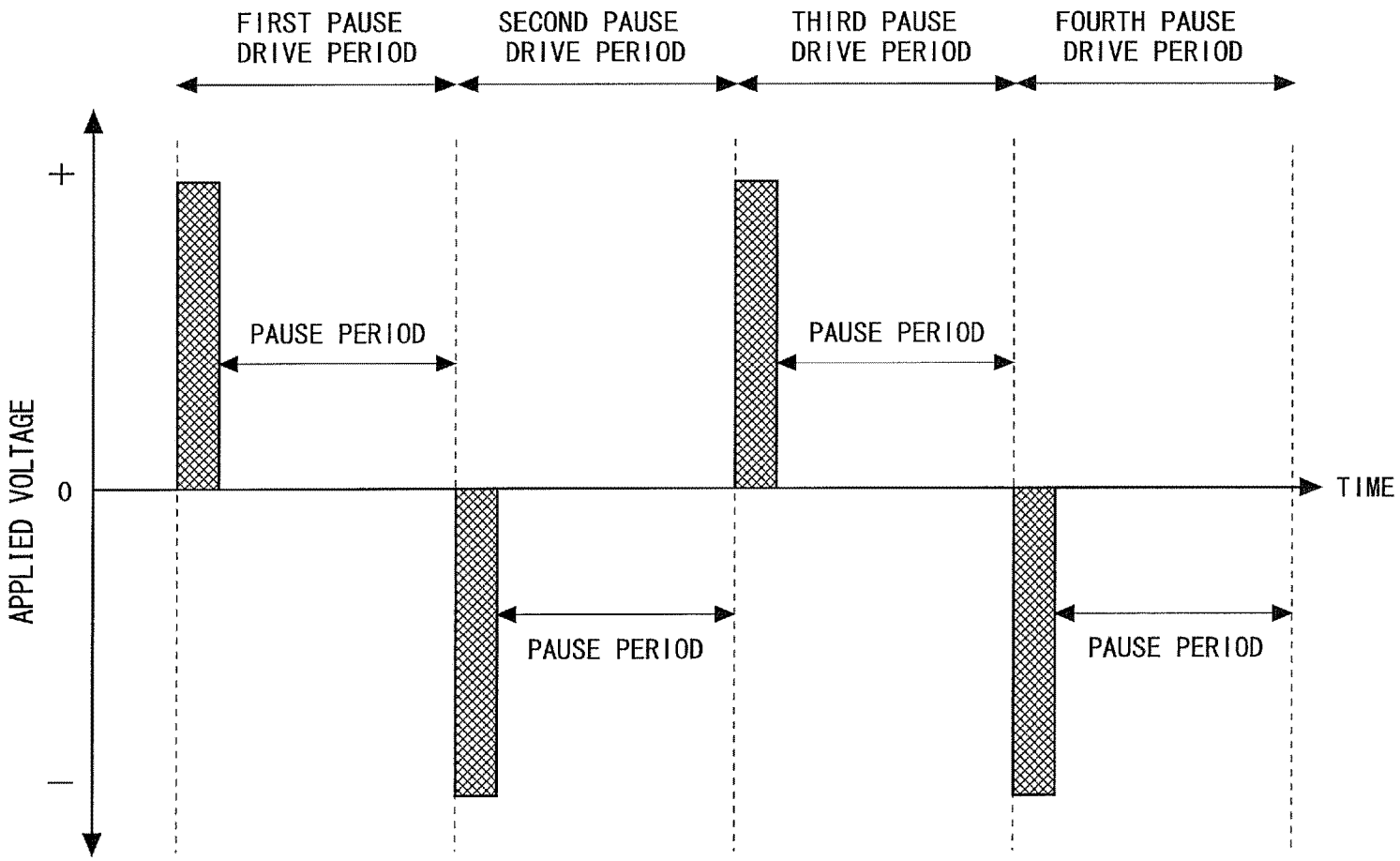
FIG. 34 is a diagram describing a conventional method for performing pause drive in an alternating-voltage drive mode.

FIG. 32 is a diagram illustrating a liquid crystal display device 600, which is equivalent to the liquid crystal display device 400 shown in FIG. 27 without the comparator circuit, and FIG. 33 is a diagram illustrating a liquid crystal display device 700, which is equivalent to the liquid crystal display device 500 shown in FIG. 31 without the comparator circuit. The liquid crystal display device 600 shown in FIG. 32 has three LUTs 670*a* to 670*c*, which have correction values stored therein for their respective temperature ranges, and the liquid crystal display device 600 selects one of the three LUTs 670*a* to 670*c* in accordance with temperature information provided by the temperature sensor 35. The liquid crystal display device 600 does not have any comparator circuit, and therefore, the LUTs 670*a* to 670*c* have only the correction values for the grayscale values for the current frame stored therein for their respective temperature ranges. In this manner, the correction values are determined solely by the grayscale values for the current frame, regardless of grayscale values for the previous frame. Accordingly, the adder circuit 50 generates a corrected image signal by adding correction values stored in one of the LUTs 670*a* to 670*c* selected in accordance with the temperature to all grayscale values for the current frame, regardless of grayscale values for the previous frame, and outputs the generated signal to the data signal line driver circuit 25.

In the liquid crystal display device 700 shown in FIG. 33, data for three types of correction values for corresponding temperature ranges is stored in the nonvolatile memory 575, and in accordance with temperature information provided by the temperature sensor 35, data for corresponding correction values is transferred to the LUT 570. As well, the liquid crystal display device 700 does not have any comparator circuit, and therefore, the nonvolatile memory 575 has stored therein only the correction values for the grayscale values for the current frame. In this manner, the correction values are determined solely by the grayscale values for the current frame, regardless of grayscale values for the previous frame. Accordingly, the adder circuit 50 of the liquid crystal display device 700 also generates a corrected image signal by adding correction values, which are selected in accordance with the temperature from among the data stored in the nonvolatile memory 575 for their respective temperature ranges, to all grayscale values for the current frame, regardless of grayscale values for the previous frame, and outputs the generated signal to the data signal line driver circuit 25. Note that in any of the cases, normal drive is performed in the same manner as in the liquid crystal display device 400 shown in FIG. 27 or the liquid crystal display device 500 shown in FIG. 31, and therefore, any description thereof will be omitted.

The present variant further eliminates the need for the comparator circuit, resulting in further reduced production cost for the liquid crystal display devices 600 and 700.

5. Others

The liquid crystal display devices according to the above embodiments and their variants are driven by dot-by-dot inversion drive. However, in addition to dot-by-dot inversion drive, other alternating-voltage drive modes, such as line-by-line inversion drive, column-by-column inversion drive, or frame-by-frame inversion drive, can also be applied to achieve the same effects as those achieved by dot-by-dot inversion drive.

INDUSTRIAL APPLICABILITY

The present invention can be applied to liquid crystal display devices capable of pause drive in an alternating-voltage drive mode.

DESCRIPTION OF THE REFERENCE CHARACTERS

10 liquid crystal panel
15 pixel forming portion
16 thin-film transistor (TFT)
17 pixel electrode
18 common electrode
20 scanning signal line driver circuit
25 data signal line driver circuit
30 timing control circuit
35 temperature sensor
40 correction circuit
50 adder circuit
60 frame memory
70, 270, 370, 470, 570, 670, 770 look-up table (LUT)
80 comparator circuit
100, 200, 300, 400, 500, 600, 700 liquid crystal display device
575 nonvolatile memory
Ccl liquid crystal capacitance
GL scanning signal line
SL data signal line

The invention claimed is:

1. A liquid crystal display device formed on an insulating substrate and performing pause drive in an alternating-voltage drive mode, the device comprising:

a plurality of scanning signal lines;

a plurality of data signal lines crossing each of the scanning signal lines;

pixel forming portions at intersections of the scanning signal lines and the data signal lines;

a correction circuit that outputs a corrected image signal which is corrected with a correction value for correcting a grayscale value of the input image signal when the correction value is provided with the correction circuit and the input image signal which is not corrected when the correction value is not provided with the correction circuit;

a scanning signal line driver circuit that sequentially selects and scans the scanning signal lines;

a data signal line driver circuit that writes either correction voltages in accordance with the corrected image signal or signal voltages in accordance with the input image signal to the data signal lines; and a timing control circuit that controls the scanning signal line driver circuit and the data signal line driver circuit, wherein, the pause drive alternatingly repeats a drive period consisting of a plurality of drive frames and a pause period following the drive period and lasting until the start of the next drive period, the correction value is determined only by the grayscale value for a current frame, the correction circuit includes an adder circuit that outputs either the corrected image signal or the image signal to the data signal line driver circuit, the adder circuit outputs a first correction image signal by adding the correction value to the grayscale value of the input image for the current frame, a second correction image signal by subtracting the correction value from the grayscale value of the input image for the current frame or the input image signal to the data signal line driver circuit at least during the first drive frame of the drive period and also outputs the input image signal to the data signal line driver circuit during the last drive frame, the data signal line driver circuit generates the signal voltage, a first correction voltage having a higher absolute value than that of the input image signal or a second correction voltage having a lower absolute value than that of the input image signal based on the input image signal, the first correction image signal or the second correction image signal, and writes the signal voltage, the first correction voltage, or the second correction voltage at least once to the data signal line, and further, writes the signal voltage having the same polarity as the written first or second correction voltage, once to the data signal line, and a voltage written by the data signal line driver circuit to the data signal line during the first drive frame of the drive period includes the first correction voltage, the second correction voltage, and the signal voltage.

2. The liquid crystal display device according to claim 1, wherein, the correction circuit includes:

a table storing the correction values; and the table provides the adder circuit with the correction value correlated with the grayscale value for the current frame for the input image signal every time the adder circuit is provided with the grayscale value for the current frame, and the adder circuit outputs the first correction image signal when the grayscale value for the current frame for the input image signal is smaller than a boundary value which is predetermined, outputs the second correction image signal when the grayscale value for the current frame for the input image signal is larger than the boundary value, and outputs the image signal when the grayscale value for the current frame for the input image signal is the same as the boundary value.

3. The liquid crystal display device according to claim 2, further comprising a temperature sensor for measuring an ambient temperature around the liquid crystal display device, wherein, the table includes a plurality of sub-tables having stored different correction values for predetermined temperature ranges, such that one of the sub-tables is selected in accordance with temperature information provided by the temperature sensor.

4. The liquid crystal display device according to claim 2, further comprising a temperature sensor for measuring an ambient temperature around the liquid crystal display device, wherein, the correction circuit further includes nonvolatile memory for storing a plurality of data items for different correction values for predetermined temperature ranges, and the nonvolatile memory selects one of the data items in accordance with temperature information provided by the temperature sensor and provides the selected data item to the table.

5. The liquid crystal display device according to claim 3, wherein, the temperature sensor is provided on the insulating substrate, and the temperature sensor provides the temperature information to the timing control circuit via serial communication.

6. The liquid crystal display device according to claim 3, wherein the temperature sensor is provided in the timing control circuit.

7. The liquid crystal display device according to claim 1, wherein the pixel forming portion includes a thin-film transistor having a control terminal connected to the scanning signal line, a first conductive terminal connected to the data signal line, a second conductive terminal connected to a pixel electrode to which the first correction voltage, the second correction voltage, or the signal voltage is to be applied, and a channel layer formed of an oxide semiconductor.

8. The liquid crystal display device according to claim 7, wherein the oxide semiconductor is InGaZnO mainly composed of indium (In), gallium (Ga), zinc (Zn), and oxygen (O).

9. The liquid crystal display device according to claim 1, wherein the pixel forming portion includes a thin-film transistor having a control terminal connected to the scanning signal line, a first conductive terminal connected to the data signal line, a second conductive terminal connected to a pixel electrode to which the first correction voltage, the second correction voltage, or the signal voltage is to be applied, and a channel layer formed of either an amorphous semiconductor or a polycrystalline semiconductor.

10. The liquid crystal display device according to claim 1, wherein the liquid crystal display device is driven by dot-by-dot inversion drive, line-by-line inversion drive, column-by-column inversion drive, or frame-by-frame inversion drive in the alternating-voltage drive mode.

11. A method for driving a liquid crystal display device performing pause drive in an alternating-voltage drive mode and including a plurality of scanning signal lines, a plurality of data signal lines crossing each of the scanning signal lines, pixel forming portions at intersections of the scanning signal lines and the data signal lines, a correction circuit that outputs a corrected image signal which is corrected with a correction value to correct a grayscale value of an input image signal when the correction value is provided by the correction circuit and an input image signal which is not corrected when the correction value is not provided by the correction circuit, a scanning signal line driver circuit that sequentially selects and scans the scanning signal lines, and a data signal line driver circuit that writes to the data signal lines correction voltages in accordance with the corrected image signal or signal voltages in accordance with the input image signal, the method comprising the steps of:

outputting a first correction image signal by adding the correction value to the grayscale value of the input image for the current frame, a second correction image signal by subtracting the correction value from the grayscale value of the input image for the current frame or the input image signal to the data signal line driver circuit at least during the first drive frame in a drive period;

outputting the input image signal to the data signal line driver circuit during the last drive frame in the drive period;

generating the signal voltage, a first correction voltage or a second correction voltage at least once to the data signal line based on the input image signal, the first correction image signal, or the second correction image signal, wherein the first correction voltage has a higher absolute value than the signal voltage, and the second correction voltage has a lower absolute value than the signal voltage;

writing the signal voltage, the first correction voltage, or the second correction voltage at least once to the data signal line; and writing a signal voltage having the same polarity as the first or second correction voltage, once to the data signal line immediately after the writing of the first or second correction voltage; wherein the correction value is determined only by the grayscale value for a current frame; and a voltage written by the data signal line driver circuit to the data signal line during the first drive frame of the drive period includes the first correction voltage, the second correction voltage, and the signal voltage.

* * * * *